US011638099B2

(12) United States Patent
Qi et al.

(10) Patent No.: US 11,638,099 B2
(45) **Date of Patent: *Apr. 25, 2023**

(54) BONE CONDUCTION SPEAKER AND COMPOUND VIBRATION DEVICE THEREOF

(71) Applicant: SHENZHEN SHOKZ CO., LTD., Guangdong (CN)

(72) Inventors: Xin Qi, Shenzhen (CN); Fengyun Liao, Shenzhen (CN); Jinbo Zheng, Shenzhen (CN); Qian Chen, Shenzhen (CN); Hao Chen, Shenzhen (CN); Lei Zhang, Shenzhen (CN); Junjiang Fu, Shenzhen (CN); Bingyan Yan, Shenzhen (CN)

(73) Assignee: SHENZHEN SHOKZ CO., LTD., Shenzhen (CN)

( * ) Notice: Subject to any disclaimer, the term of this patent is extended or adjusted under 35 U.S.C. 154(b) by 75 days.

This patent is subject to a terminal disclaimer.

(21) Appl. No.: 17/218,677

(22) Filed: Mar. 31, 2021

(65) Prior Publication Data

US 2021/0250697 A1 Aug. 12, 2021

Related U.S. Application Data

(63) Continuation-in-part of application No. 17/170,955, filed on Feb. 9, 2021, and a continuation-in-part of (Continued)

(30) Foreign Application Priority Data

Dec. 23, 2011 (CN) ..... 201110438083.9
Apr. 30, 2019 (CN) ..... 201910364346.2
(Continued)

(51) Int. Cl.
*H04R 9/06* (2006.01)
*H04R 1/00* (2006.01)
(Continued)

(52) U.S. Cl.
CPC ..... *H04R 9/063* (2013.01); *H04R 1/00* (2013.01); *H04R 1/10* (2013.01); *H04R 9/02* (2013.01);
(Continued)

(58) Field of Classification Search
CPC . H04R 9/063; H04R 1/00; H04R 1/10; H04R 1/1075; H04R 9/02; H04R 9/06;
(Continued)

(56) References Cited

U.S. PATENT DOCUMENTS 2,075,198 A 3/1937 Hand
4,418,248 A 11/1983 Mathis
(Continued)

FOREIGN PATENT DOCUMENTS

CN 1842319 A 1/2006
CN 1976541 A 6/2007
(Continued)

OTHER PUBLICATIONS

First Office Action in Chinese Application No. 201110438083.9 dated Sep. 27, 2012, 10 pages.
(Continued)

*Primary Examiner* — Norman Yu
(74) *Attorney, Agent, or Firm* — Metis IP LLC

(57) ABSTRACT

The present disclosure relates to a bone conduction speaker and its compound vibration device. The compound vibration device comprises a vibration conductive plate and a vibration board, the vibration conductive plate is set to be the first torus, where at least two first rods inside it converge to its center; the vibration board is set as the second torus, where
(Continued)

at least two second rods inside it converge to its center. The vibration conductive plate is fixed with the vibration board; the first torus is fixed on a magnetic system, and the second torus comprises a fixed voice coil, which is driven by the magnetic system. The bone conduction speaker in the present disclosure and its compound vibration device adopt the fixed vibration conductive plate and vibration board, making the technique simpler with a lower cost; because the two adjustable parts in the compound vibration device can adjust both low frequency and high frequency area, the frequency response obtained is flatter and the sound is broader.

20 Claims, 19 Drawing Sheets

Related U.S. Application Data application No. 17/170,817, filed on Feb. 8, 2021, now Pat. No. 11,395,072, which is a continuation of application No. 17/161,717, filed on Jan. 29, 2021, now Pat. No. 11,399,234, said application No. 17/170,955 is a continuation of application No. PCT/CN2020/083631, filed on Apr. 8, 2020, said application No. 17/161,717 is a continuation-in-part of application No. 16/833,839, filed on Mar. 30, 2020, now Pat. No. 11,399,245, and a continuation-in-part of application No. 16/159,070, filed on Oct. 12, 2018, now Pat. No. 10,911,876, said application No. 16/833,839 is a continuation of application No. 15/752,452, filed on Feb. 13, 2018, now Pat. No. 10,609,496, said application No. 16/159,070 is a continuation of application No. 15/197,050, filed as application No. PCT/CN2015/086907 on Aug. 13, 2015, now Pat. No. 10,117,026, said application No. 15/197,050 is a continuation of application No. 14/513,371, filed on Oct. 14, 2014, now Pat. No. 9,402,116, which is a continuation of application No. 13/719,754, filed on Dec. 19, 2012, now Pat. No. 8,891,792.

(30) Foreign Application Priority Data

Sep. 19, 2019 (CN) ..... 201910888067.6
Sep. 19, 2019 (CN) ..... 201910888762.2

(51) Int. Cl.
*H04R 9/02* (2006.01)
*H04R 31/00* (2006.01)
*H04R 1/10* (2006.01)
*H04R 25/00* (2006.01)

(52) U.S. Cl.
CPC ..... *H04R 9/025* (2013.01); *H04R 9/066* (2013.01); *H04R 31/00* (2013.01); *H04R 25/606* (2013.01); *H04R 2460/13* (2013.01)

(58) Field of Classification Search
CPC ..... H04R 9/025; H04R 9/066; H04R 11/02; H04R 31/00; H04R 25/606; H04R 2225/021; H04R 2225/023; H04R 2225/67; H04R 2400/03; H04R 2420/07; H04R 2460/13; H04R 2499/11; H04R 25/48
USPC ..... 381/151, 380, 162, 182, 326; 340/7.6; 600/25
See application file for complete search history.

(56) References Cited

U.S. PATENT DOCUMENTS

| | | | | |
|---|---|---|---|---|
| 5,127,060 | A | 6/1992 | Paddock | |
| 5,673,328 | A | 9/1997 | Wandl et al. | |
| 5,734,132 | A | 3/1998 | Proni | |
| 5,790,684 | A | 8/1998 | Niino et al. | |
| 6,389,148 | B1 | 5/2002 | Yoo et al. | |
| 6,738,485 | B1 | 5/2004 | Boesen | |
| 6,850,138 | B1 | 2/2005 | Sakai | |
| 8,891,792 | B2 | 11/2014 | Qi et al. | |
| 9,226,075 | B2 | 12/2015 | Lee | |
| 9,253,563 | B2 | 2/2016 | Fukuda | |
| 9,742,887 | B2 | 8/2017 | Hosoi et al. | |
| 2003/0012395 | A1 | 1/2003 | Fukuda | |
| 2003/0053651 | A1 | 3/2003 | Koura et al. | |
| 2004/0105566 | A1 | 6/2004 | Matsunaga et al. | |
| 2004/0131218 | A1 | 7/2004 | Dedieu et al. | |
| 2006/0098829 | A1 | 5/2006 | Kobayashi | |
| 2006/0165246 | A1 | 7/2006 | Lee et al. | |
| 2006/0262954 | A1 | 11/2006 | Lee et al. | |
| 2007/0053536 | A1 | 3/2007 | Westerkull | |
| 2008/0166007 | A1 | 7/2008 | Hankey et al. | |
| 2009/0097681 | A1 | 4/2009 | Puria et al. | |
| 2009/0209806 | A1 | 8/2009 | Hakansson | |
| 2009/0245553 | A1 | 10/2009 | Parker | |
| 2009/0285417 | A1 | 11/2009 | Shin et al. | |
| 2010/0046783 | A1 | 2/2010 | Huang | |
| 2010/0329485 | A1 | 12/2010 | Fukuda | |
| 2011/0022119 | A1 | 1/2011 | Parker | |
| 2012/0020501 | A1* | 1/2012 | Lee | H04R 1/1016 381/151 |
| 2012/0083860 | A1 | 4/2012 | Hakansson | |
| 2012/0281861 | A1 | 11/2012 | Lin | |
| 2012/0286765 | A1* | 11/2012 | Heuvel | H04R 25/606 600/25 |
| 2012/0302822 | A1 | 11/2012 | Van Himbeeck et al. | |
| 2013/0121513 | A1 | 5/2013 | Adachi | |
| 2013/0156241 | A1 | 6/2013 | Jinton | |
| 2013/0163791 | A1 | 6/2013 | Qi et al. | |
| 2013/0308798 | A1 | 11/2013 | Lee | |
| 2014/0064533 | A1 | 3/2014 | Kasic, II | |
| 2014/0270293 | A1 | 9/2014 | Ruppersberg et al. | |
| 2015/0130945 | A1* | 5/2015 | Yu | G01S 19/13 381/151 |
| 2015/0208183 | A1 | 7/2015 | Bern | |
| 2015/0264473 | A1 | 9/2015 | Fukuda | |
| 2016/0037243 | A1 | 2/2016 | Lippert et al. | |
| 2016/0127841 | A1 | 5/2016 | Horii | |
| 2017/0201823 | A1 | 7/2017 | Shetye et al. | |
| 2017/0374479 | A1 | 12/2017 | Qi et al. | |
| 2018/0052954 | A1 | 2/2018 | Beltrami et al. | |
| 2019/0014425 | A1 | 1/2019 | Liao et al. | |
| 2019/0238971 | A1 | 8/2019 | Wakeland et al. | |

FOREIGN PATENT DOCUMENTS

| | | | |
|---|---|---|---|
| CN | 101098353 | A | 1/2008 |
| CN | 202435598 | U | 9/2012 |
| CN | 203233520 | U | 10/2013 |
| CN | 105007551 | A | 10/2015 |
| CN | 105101019 | A | 11/2015 |
| CN | 105101020 | A | 11/2015 |
| CN | 105142077 | A | 12/2015 |
| CN | 204887455 | U | 12/2015 |
| CN | 205142506 | U | 4/2016 |
| EP | 1404146 | A1 | 3/2004 |
| EP | 2234413 | B1 | 11/2020 |
| JP | S5574290 | A | 6/1980 |
| JP | 07007797 | A | 1/1995 |
| JP | 2003264882 | A | 9/2003 |
| JP | 2004064457 | A1 | 2/2004 |
| JP | 2004158961 | A | 6/2004 |
| JP | 2005151183 | A | 6/2005 |
| JP | 2006025333 | A | 1/2006 |
| JP | 2007129384 | A | 5/2007 |
| JP | 2008017398 | A | 1/2008 |

(56) References Cited

FOREIGN PATENT DOCUMENTS

| | | | |
|---|---|---|---|
| JP | 2008054063 | A | 3/2008 |
| JP | 2011160175 | A | 8/2011 |
| JP | 2013243564 | A | 12/2013 |
| KR | 20010111653 | A | 12/2001 |
| KR | 20050030183 | A | 3/2005 |
| KR | 20070122104 | A | 12/2007 |
| KR | 20080101166 | A | 11/2008 |
| KR | 20090082999 | A | 8/2009 |
| KR | 20090091378 | A | 8/2009 |
| KR | 20110037483 | A | 4/2011 |
| KR | 200476572 | Y1 | 3/2015 |
| WO | 0219759 | A1 | 3/2002 |
| WO | 2006088410 | A1 | 8/2006 |
| WO | 2010114195 | A1 | 10/2010 |
| WO | 2018107141 | A1 | 6/2018 |

OTHER PUBLICATIONS

The Extended European Search Report in European Application No. 12860348.7 dated Apr. 28, 2015, 7 pages.
International Search Report in PCT/CN2012/086513 dated Mar. 14, 2013, 5 pages.
Written Opinion in PCT/CN2012/086513 dated Mar. 14, 2013, 10 pages.
Notice of Reasons for Rejection in Japanese Application No. 2020-088413 dated Aug. 3, 2021, 8 pages.
Notice of Preliminary Rejection in Korean Application No. 10-2022-7003237 dated Apr. 13, 2022, 14 pages.
Written Opinion in PCT/CN2020/083631 dated Jun. 29, 2020, 4 pages.
International Search Report in PCT/CN2020/083631 dated Jun. 29, 2020, 4 pages.
Decision to Grant a Patent in Japanese Application No. 2018-146021 dated Jul. 21, 2020, 5 pages.
Notice of Preliminary Rejection in Republic of Korea Application No. 10-2018-7007115 dated May 20, 2021, 9 pages.
International Search Report in PCT/CN2015/086907 dated May 6, 2016, 10 pages.
Written Opinion in PCT/CN2015/086907 dated May 6, 2016, 12 pages.
Communication Pursuant to Article 94(3) EPC in European Application No. 15900793.9 dated Apr. 10, 2019, 6 pages.
Communication Pursuant to Article 94(3) EPC in European Application No. 15900793.9 dated Apr. 28, 2020, 9 pages.
Notice of Reasons for Rejection in Japanese Application No. 2018-506985 dated Sep. 3, 2019, 8 pages.
Notice of Reasons for Rejection in Japanese Application No. 2018-146019 dated Jul. 23, 2019, 8 pages.
Decision of Final Rejection in Japanese Application No. 2018-146019 dated Jan. 21, 2020, 9 pages.
Notice of Reasons for Rejection in Japanese Application No. 2018-146020 dated Jul. 23, 2019, 8 pages.
Notice of Reasons for Rejection in Japanese Application No. 2018-146021 dated Jul. 30, 2019, 8 pages.
M. Gripper et al., Using the Callsign Acquisition Test (CAT) to Compare the Speech Intelligibility of Air Versus Bone Conduction, International Journal of Industrial Ergonomics, 37(7): 631-641, 2007.
Martin L. Lenhardt et al., Measurement of Bone Conduction Levels for High Frequencies, International Tinnitus Journal, 8(1): 9-12, 2002.
The Extended European Search Report in European Application No. 21186537.3 dated Nov. 9, 2021, 9 pages.
Notice of Reasons for Refusal in Japanese Application No. 2020-088413 dated Sep. 6, 2022, 11 pages.
The Second Notice of Preliminary Rejection in Korean Application No. 10-2022-7003237 dated Oct. 11, 2022, 14 pages.
Notice of Reasons for Refusal in Japanese Application No. 2021-179711 dated Oct. 18, 2022, 8 pages.
The Office Action in Brazilian Application No. BR112018002854-1 dated Feb. 24, 2023, 8 pages.
Paula Henry et al., Bone Conduction: Anatomy, Physiology, and Communication, Army Research Laboratory, 2007, 206 pages.

* cited by examiner

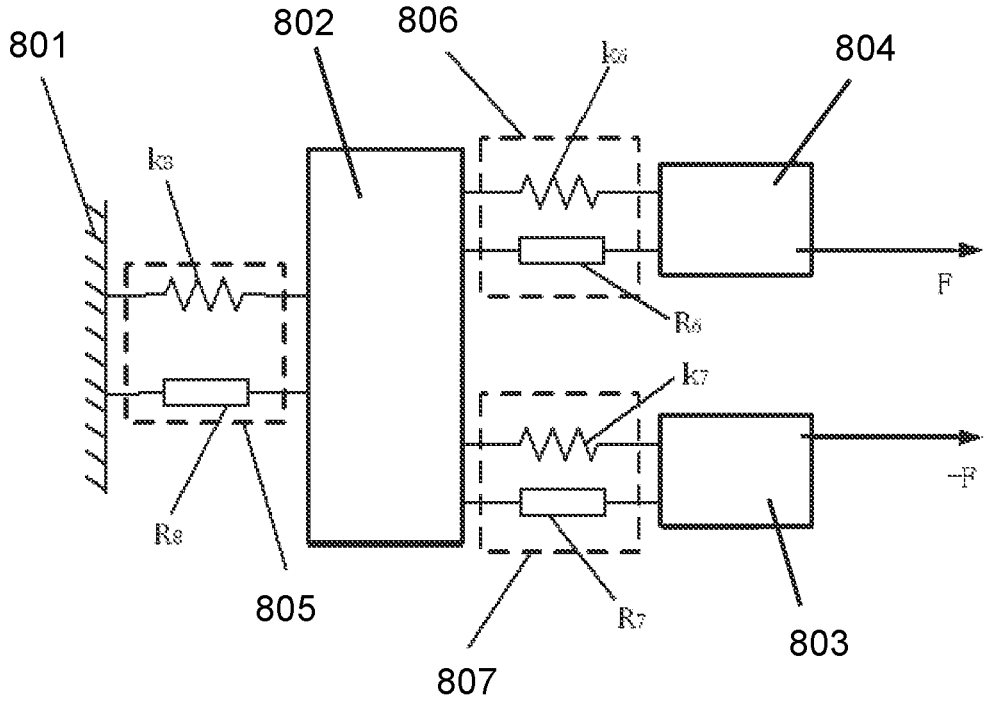
FIG. 8-A

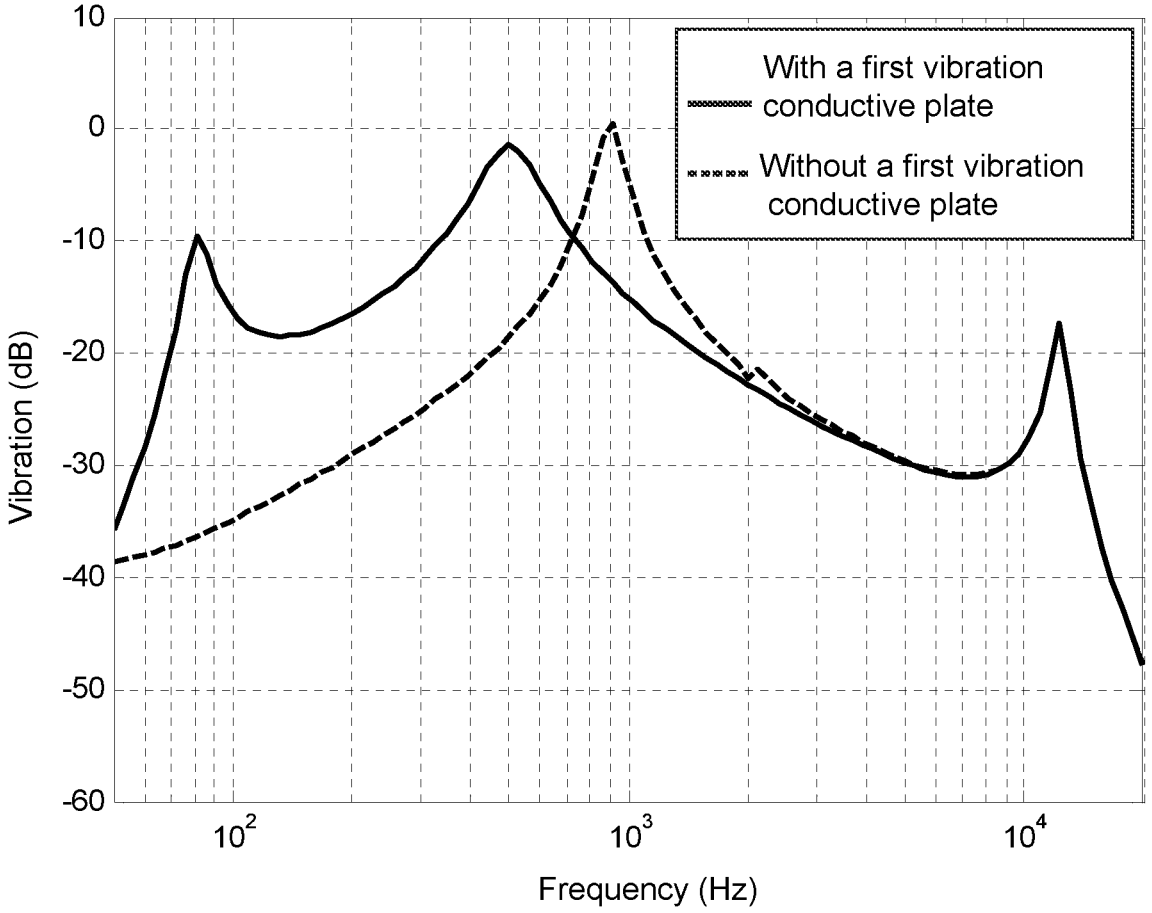
FIG. 8-B

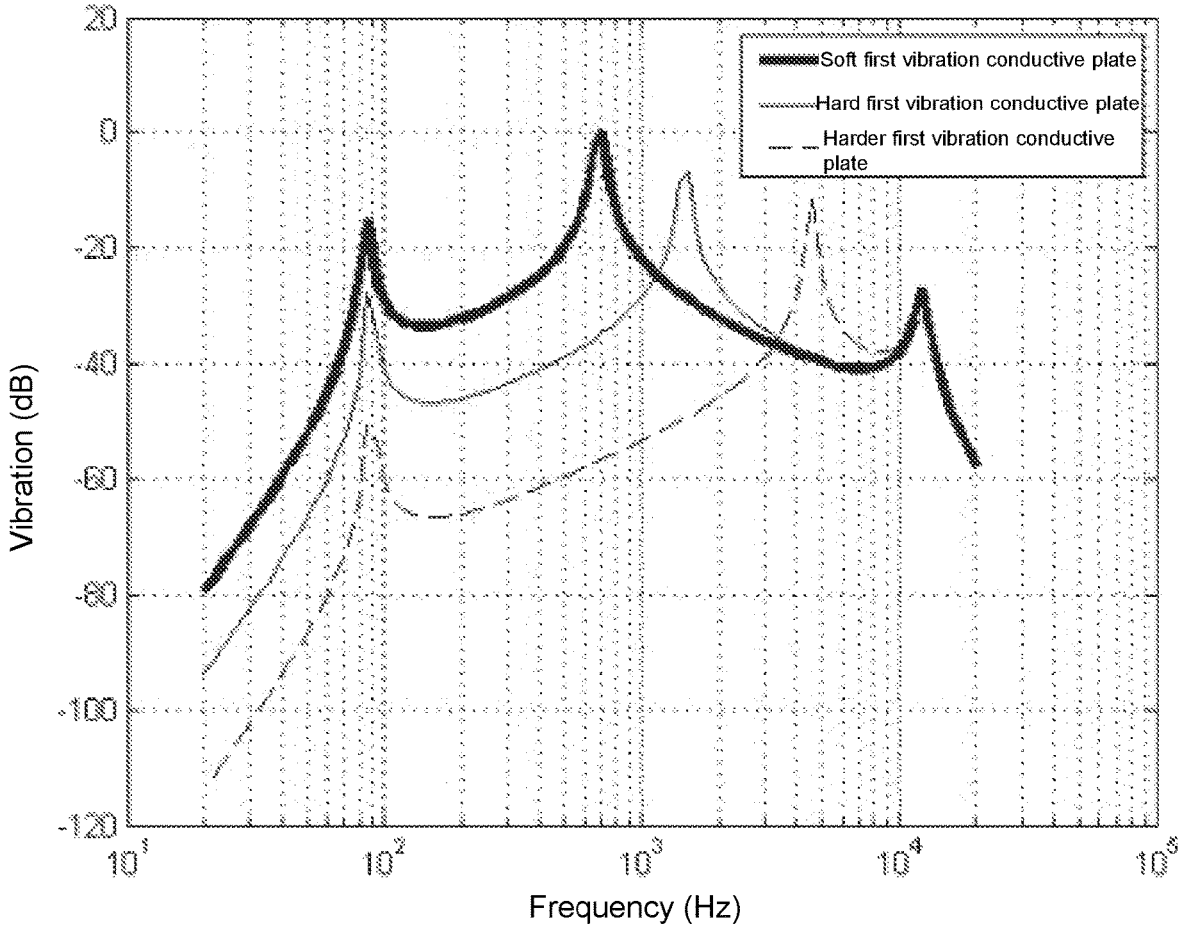
FIG. 8-C

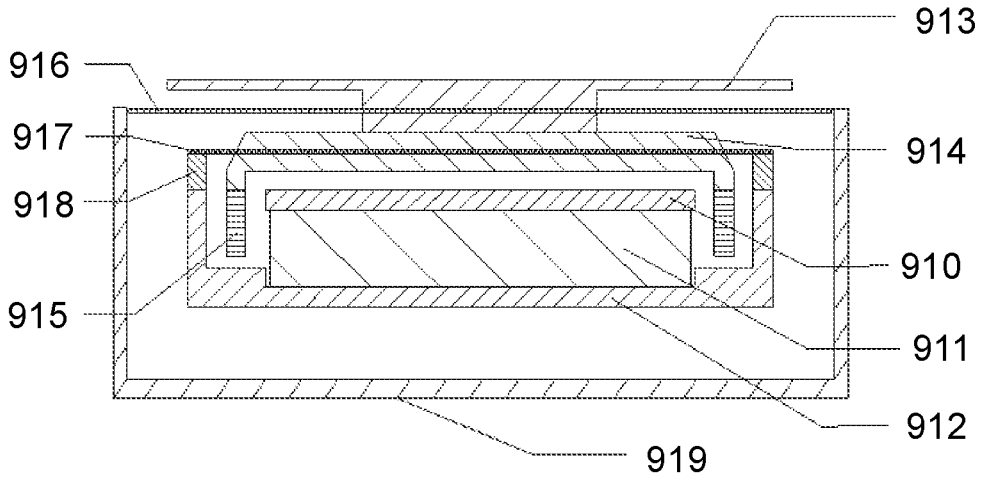
FIG. 9-A

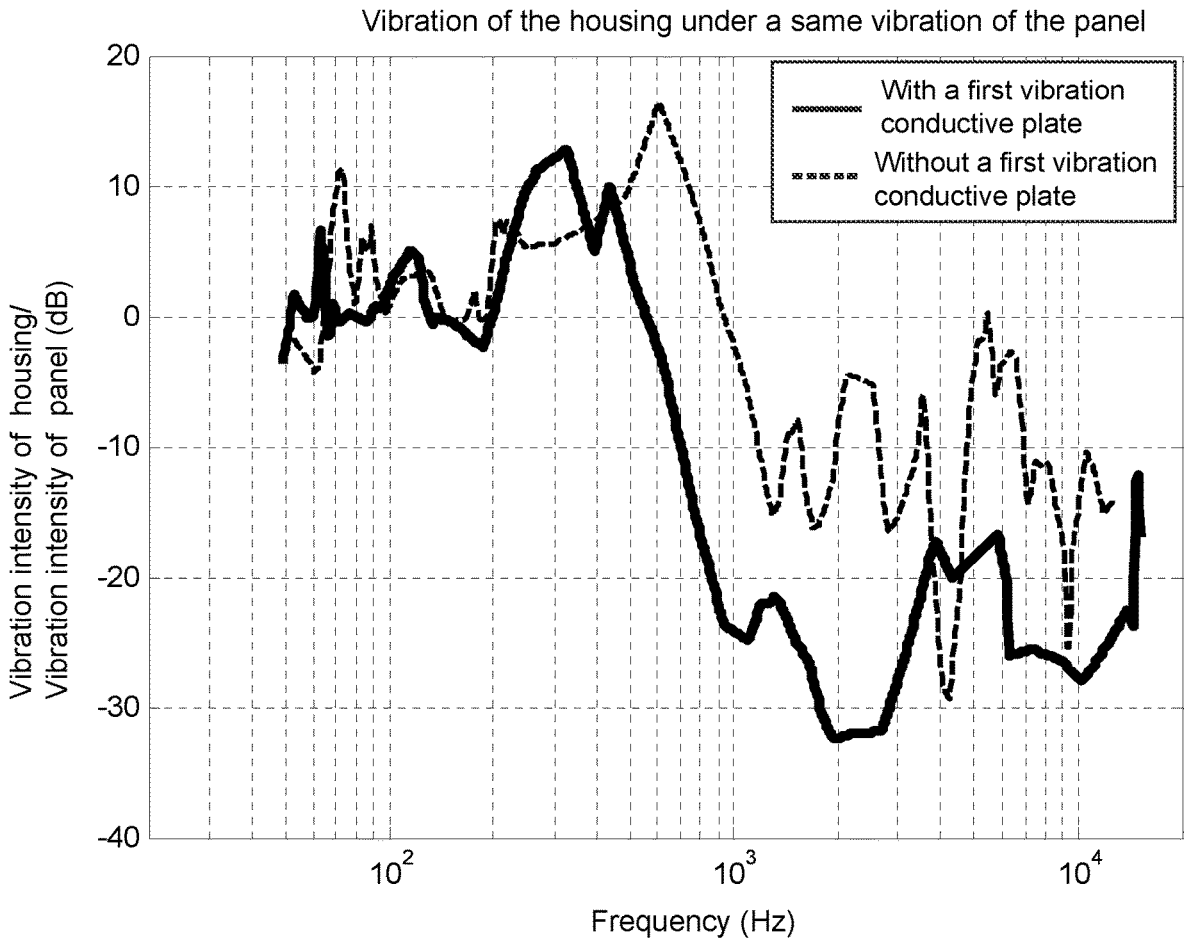
FIG. 9-B

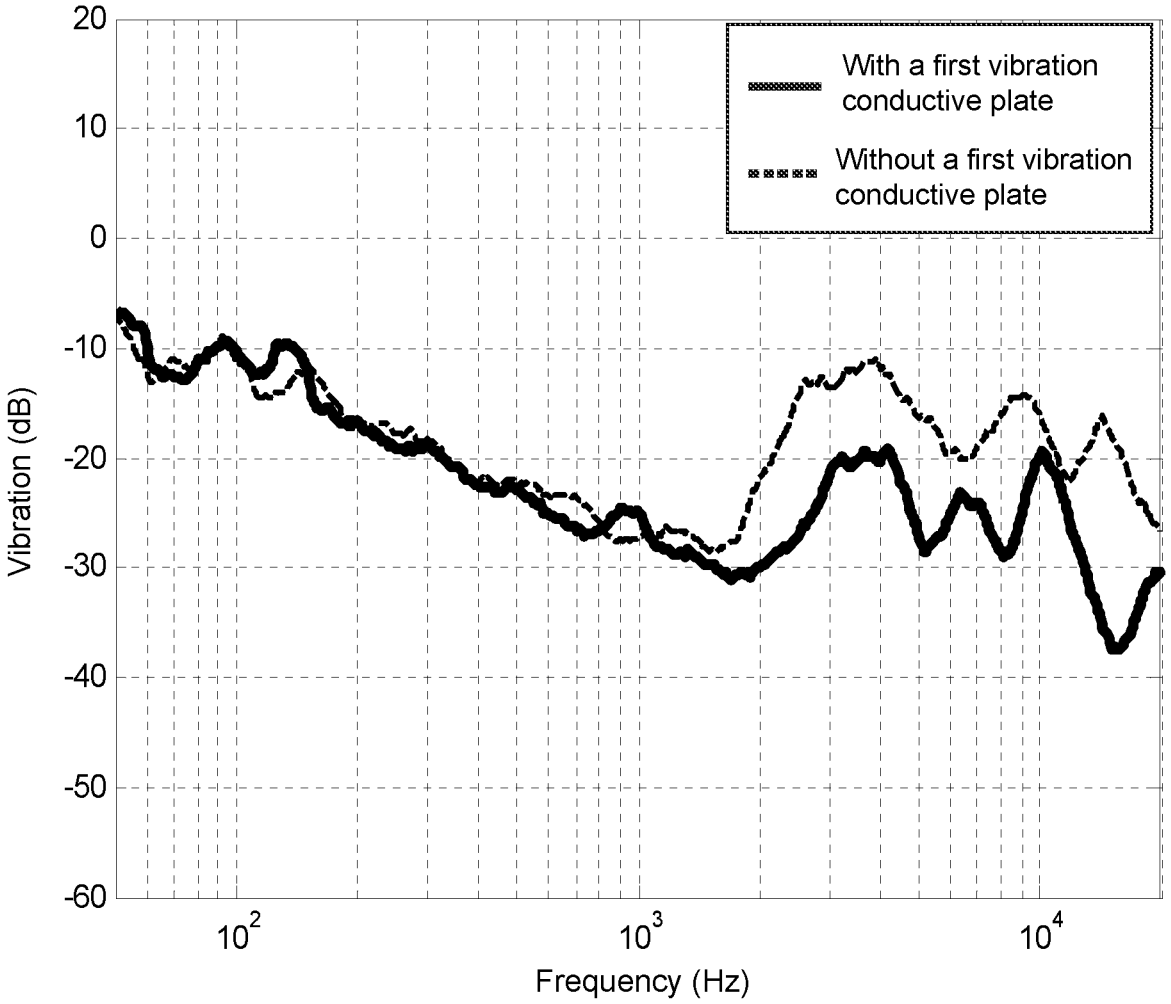
FIG. 9-C

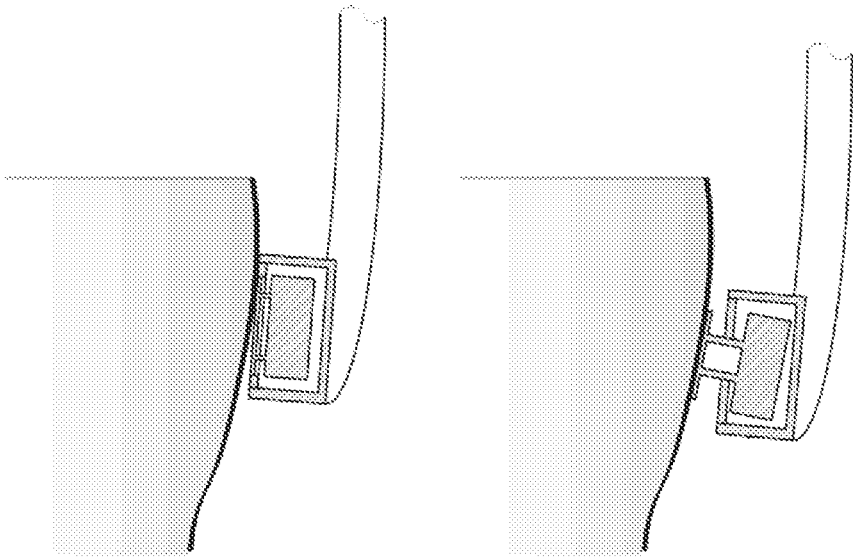
FIG. 11-A

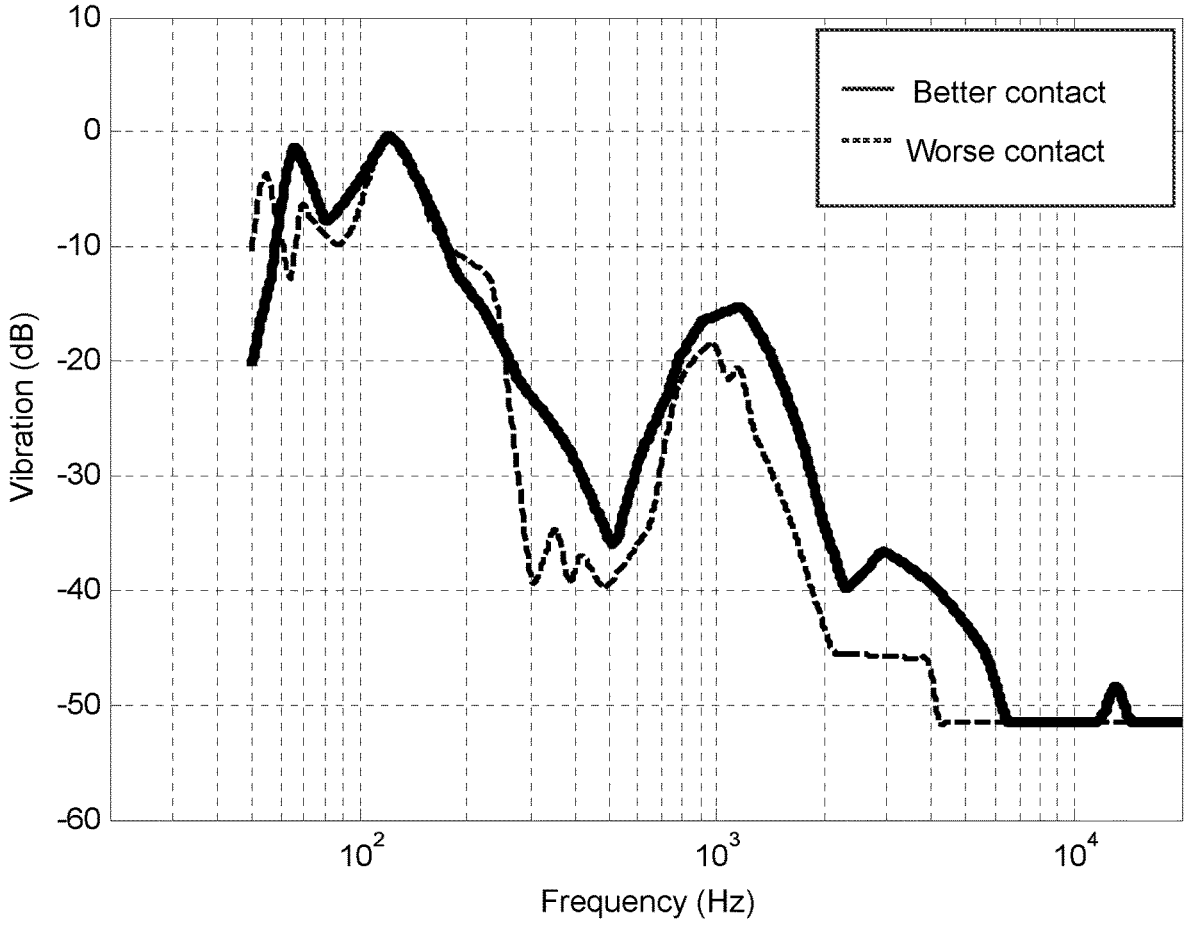
FIG. 11-B

1400

1600

BONE CONDUCTION SPEAKER AND COMPOUND VIBRATION DEVICE THEREOF

CROSS-REFERENCE TO RELATED APPLICATIONS

This application is a continuation-in-part application of U.S. patent application Ser. No. 17/170,817, filed on Feb. 8, 2021, which is a continuation of U.S. patent application Ser. No. 17/161,717, filed on Jan. 29, 2021, which is a continuation-in-part application of U.S. patent application Ser. No. 16/159,070 (issued as U.S. Pat. No. 10,911,876), filed on Oct. 12, 2018, which is a continuation of U.S. patent application Ser. No. 15/197,050 (issued as U.S. Pat. No. 10,117,026), filed on Jun. 29, 2016, which is a continuation of U.S. patent application Ser. No. 14/513,371 (issued as U.S. Pat. No. 9,402,116), filed on Oct. 14, 2014, which is a continuation of U.S. patent application Ser. No. 13/719,754 (issued as U.S. Pat. No. 8,891,792), filed on Dec. 19, 2012, which claims priority to Chinese Patent Application No. 201110438083.9, filed on Dec. 23, 2011; U.S. patent application Ser. No. 17/161,717, filed on Jan. 29, 2021 is also a continuation-in-part application of U.S. patent application Ser. No. 16/833,839, filed on Mar. 30, 2020, which is a continuation of U.S. application Ser. No. 15/752,452 (issued as U.S. Pat. No. 10,609,496), filed on Feb. 13, 2018, which is a national stage entry under 35 U.S.C. § 371 of International Application No. PCT/CN2015/086907, filed on Aug. 13, 2015; this application is also a continuation-in-part of U.S. patent application Ser. No. 17/170,955 filed on Feb. 9, 2021, which is a continuation of International Application No. PCT/CN2020/083631, filed on Apr. 8, 2020, which claims priority to Chinese Application No. 201910888067.6, filed on Sep. 19, 2019, Chinese Application No. 201910888762.2, filed on Sep. 19, 2019, and Chinese Application No. 201910364346.2, filed on Apr. 30, 2019. Each of the above-referenced applications is hereby incorporated by reference.

TECHNICAL FIELD

The present disclosure relates to improvements on a bone conduction speaker and its components, in detail, relates to a bone conduction speaker and its compound vibration device, while the frequency response of the bone conduction speaker has been improved by the compound vibration device, which is composed of vibration boards and vibration conductive plates.

BACKGROUND

Based on the current technology, the principle that we can hear sounds is that the vibration transferred through the air in our external acoustic meatus, reaches to the ear drum, and the vibration in the ear drum drives our auditory nerves, makes us feel the acoustic vibrations. The current bone conduction speakers are transferring vibrations through our skin, subcutaneous tissues and bones to our auditory nerves, making us hear the sounds.

When the current bone conduction speakers are working, with the vibration of the vibration board, the shell body, fixing the vibration board with some fixers, will also vibrate together with it, thus, when the shell body is touching our post auricles, cheeks, forehead or other parts, the vibrations will be transferred through bones, making us hear the sounds clearly.

However, the frequency response curves generated by the bone conduction speakers with current vibration devices are shown as the two solid lines in FIG. 4. In ideal conditions, the frequency response curve of a speaker is expected to be a straight line, and the top plain area of the curve is expected to be wider, thus the quality of the tone will be better, and easier to be perceived by our ears. However, the current bone conduction speakers, with their frequency response curves shown as FIG. 4, have overtopped resonance peaks either in low frequency area or high frequency area, which has limited its tone quality a lot. Thus, it is very hard to improve the tone quality of current bone conduction speakers containing current vibration devices. The current technology needs to be improved and developed.

SUMMARY

The purpose of the present disclosure is providing a bone conduction speaker and its compound vibration device, to improve the vibration parts in current bone conduction speakers, using a compound vibration device composed of a vibration board and a vibration conductive plate to improve the frequency response of the bone conduction speaker, making it flatter, thus providing a wider range of acoustic sound.

The technical proposal of present disclosure is listed as below:

A compound vibration device in bone conduction speaker contains a vibration conductive plate and a vibration board, the vibration conductive plate is set as the first torus, where at least two first rods in it converge to its center. The vibration board is set as the second torus, where at least two second rods in it converge to its center. The vibration conductive plate is fixed with the vibration board. The first torus is fixed on a magnetic system, and the second torus contains a fixed voice coil, which is driven by the magnetic system.

In the compound vibration device, the magnetic system contains a baseboard, and an annular magnet is set on the board, together with another inner magnet, which is concentrically disposed inside this annular magnet, as well as an inner magnetic conductive plate set on the inner magnet, and the annular magnetic conductive plate set on the annular magnet. A grommet is set on the annular magnetic conductive plate to fix the first torus. The voice coil is set between the inner magnetic conductive plate and the annular magnetic plate.

In the compound vibration device, the number of the first rods and the second rods are both set to be three.

In the compound vibration device, the first rods and the second rods are both straight rods.

In the compound vibration device, there is an indentation at the center of the vibration board, which adapts to the vibration conductive plate.

In the compound vibration device, the vibration conductive plate rods are staggered with the vibration board rods.

In the compound vibration device, the staggered angles between rods are set to be 60 degrees.

In the compound vibration device, the vibration conductive plate is made of stainless steel, with a thickness of 0.1-0.2 mm, and, the width of the first rods in the vibration conductive plate is 0.5-1.0 mm; the width of the second rods in the vibration board is 1.6-2.6 mm, with a thickness of 0.8-1.2 mm.

In the compound vibration device, the number of the vibration conductive plate and the vibration board is set to be more than one. They are fixed together through their centers and/or torus.

A bone conduction speaker comprises a compound vibration device which adopts any methods stated above.

The bone conduction speaker and its compound vibration device as mentioned in the present disclosure, adopting the fixed vibration boards and vibration conductive plates, make the technique simpler with a lower cost. Also, because the two parts in the compound vibration device can adjust low frequency and high frequency areas, the achieved frequency response is flatter and wider, the possible problems like abrupt frequency responses or feeble sound caused by single vibration device will be avoided.

BRIEF DESCRIPTION OF THE DRAWINGS

FIG. 8-A illustrates an equivalent vibration model of the vibration portion of the bone conduction speaker according to some embodiments of the present disclosure;

FIG. 8-B illustrates a vibration response curve of the bone conduction speaker according to one specific embodiment of the present disclosure;

FIG. 8-C illustrates a vibration response curve of the bone conduction speaker according to one specific embodiment of the present disclosure;

FIG. 9-A illustrates a structure of the vibration generation portion of the bone conduction speaker according to one specific embodiment of the present disclosure;

FIG. 9-B illustrates a vibration response curve of the bone conduction speaker according to one specific embodiment of the present disclosure;

FIG. 9-C illustrates a sound leakage curve of the bone conduction speaker according to one specific embodiment of the present disclosure;

FIG. 11-A illustrates an application scenario of the bone conduction speaker according to one specific embodiment of the present disclosure;

FIG. 11-B illustrates a vibration response curve of the bone conduction speaker according to one specific embodiment of the present disclosure;

DETAILED DESCRIPTION

A detailed description of the implements of the present disclosure is stated here, together with attached figures.

Figure 1:
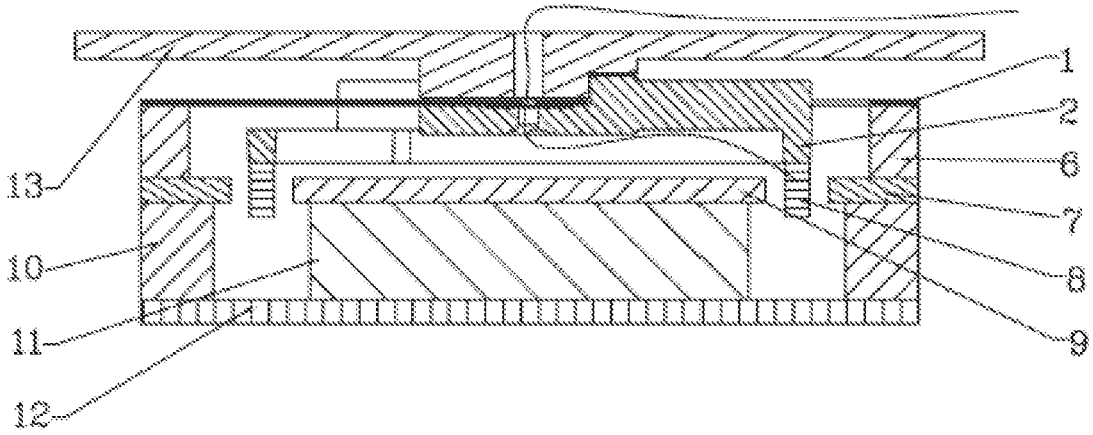
FIG. 1 illustrates a longitudinal section view of the bone conduction speaker in the present disclosure.
Figure 2:
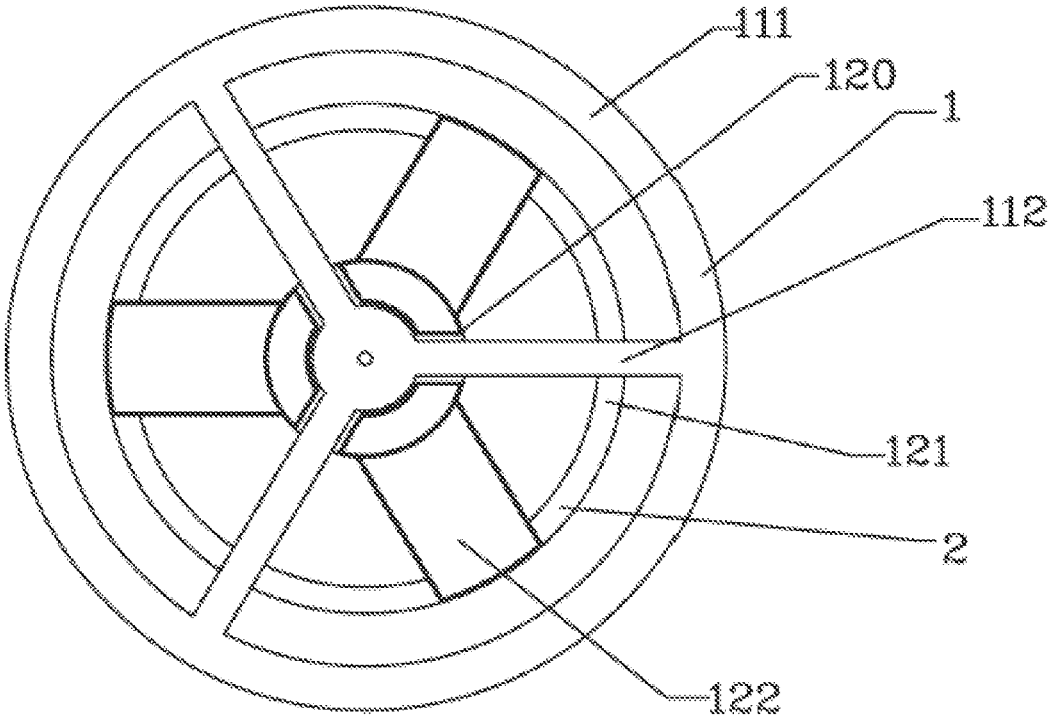
FIG. 2 illustrates a perspective view of the vibration parts in the bone conduction speaker in the present disclosure.
Figure 3:
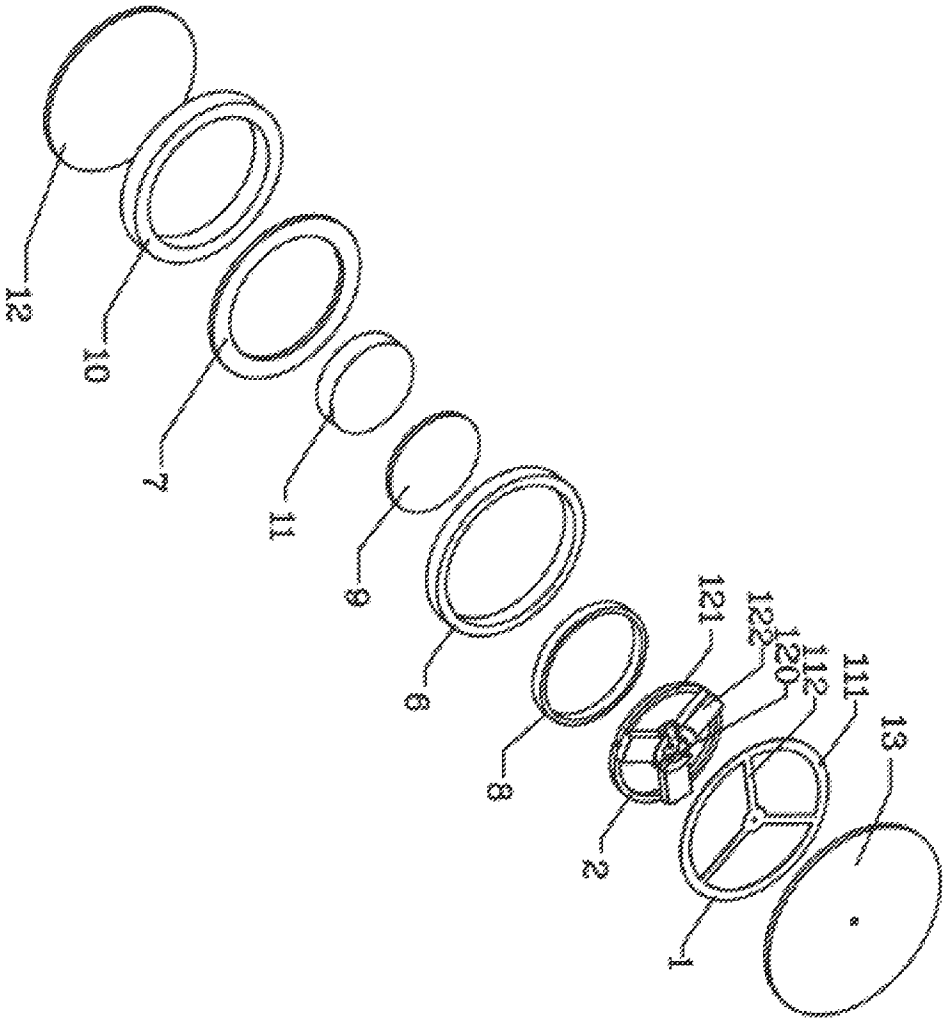
FIG. 3 illustrates an exploded perspective view of the bone conduction speaker in the present disclosure.

As shown in FIG. 1 and FIG. 3, the compound vibration device in the present disclosure of bone conduction speaker, comprises: the compound vibration parts composed of vibration conductive plate 1 and vibration board 2, the vibration conductive plate 1 is set as the first torus 111 and three first rods 112 in the first torus converging to the center of the torus, the converging center is fixed with the center of the vibration board 2. The center of the vibration board 2 is an indentation 120, which matches the converging center and the first rods. The vibration board 2 contains a second torus 121, which has a smaller radius than the vibration conductive plate 1, as well as three second rods 122, which is thicker and wider than the first rods 112. The first rods 112 and the second rods 122 are staggered, present but not limited to an angle of 60 degrees, as shown in FIG. 2. A better solution is, both the first and second rods are all straight rods.

Obviously the number of the first and second rods can be more than two, for example, if there are two rods, they can be set in a symmetrical position; however, the most economic design is working with three rods. Not limited to this rods setting mode, the setting of rods in the present disclosure can also be a spoke structure with four, five or more rods.

The vibration conductive plate 1 is very thin and can be more elastic, which is stuck at the center of the indentation 120 of the vibration board 2. Below the second torus 121 spliced in vibration board 2 is a voice coil 8. The compound vibration device in the present disclosure also comprises a bottom plate 12, where an annular magnet 10 is set, and an inner magnet 11 is set in the annular magnet 10 concentrically. An inner magnet conduction plate 9 is set on the top of the inner magnet 11, while annular magnet conduction plate 7 is set on the annular magnet 10, a grommet 6 is fixed above the annular magnet conduction plate 7, the first torus 111 of the vibration conductive plate 1 is fixed with the grommet 6. The whole compound vibration device is connected to the outside through a panel 13, the panel 13 is fixed with the vibration conductive plate 1 on its converging center, stuck and fixed at the center of both vibration conductive plate 1 and vibration board 2.

It should be noted that, both the vibration conductive plate and the vibration board can be set more than one, fixed with each other through either the center or staggered with both center and edge, forming a multilayer vibration structure, corresponding to different frequency resonance ranges, thus achieve a high tone quality earphone vibration unit with a gamut and full frequency range, despite of the higher cost.

The bone conduction speaker contains a magnet system, composed of the annular magnet conductive plate 7, annular magnet 10, bottom plate 12, inner magnet 11 and inner magnet conductive plate 9, because the changes of audio-frequency current in the voice coil 8 cause changes of magnet field, which makes the voice coil 8 vibrate. The compound vibration device is connected to the magnet system through grommet 6. The bone conduction speaker connects with the outside through the panel 13, being able to transfer vibrations to human bones.

Figure 6:
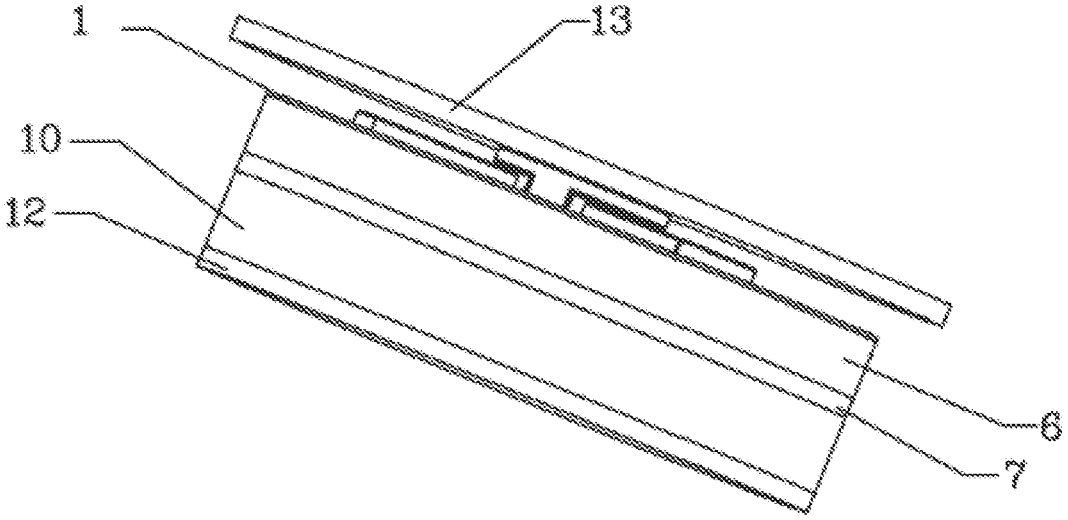
FIG. 6 illustrates a perspective view of the bone conduction speaker in the present disclosure.

In the better implement examples of the present bone conduction speaker and its compound vibration device, the magnet system, composed of the annular magnet conductive plate 7, annular magnet 10, inner magnet conduction plate 9, inner magnet 11 and bottom plate 12, interacts with the voice coil which generates changing magnet field intensity when its current is changing, and inductance changes accordingly, forces the voice coil 8 move longitudinally, then causes the vibration board 2 to vibrate, transfers the vibration to the vibration conductive plate 1, then, through the contact between panel 13 and the post ear, cheeks or forehead of the human beings, transfers the vibrations to human bones, thus generates sounds. A complete product unit is shown in FIG. 6.

Figure 5:
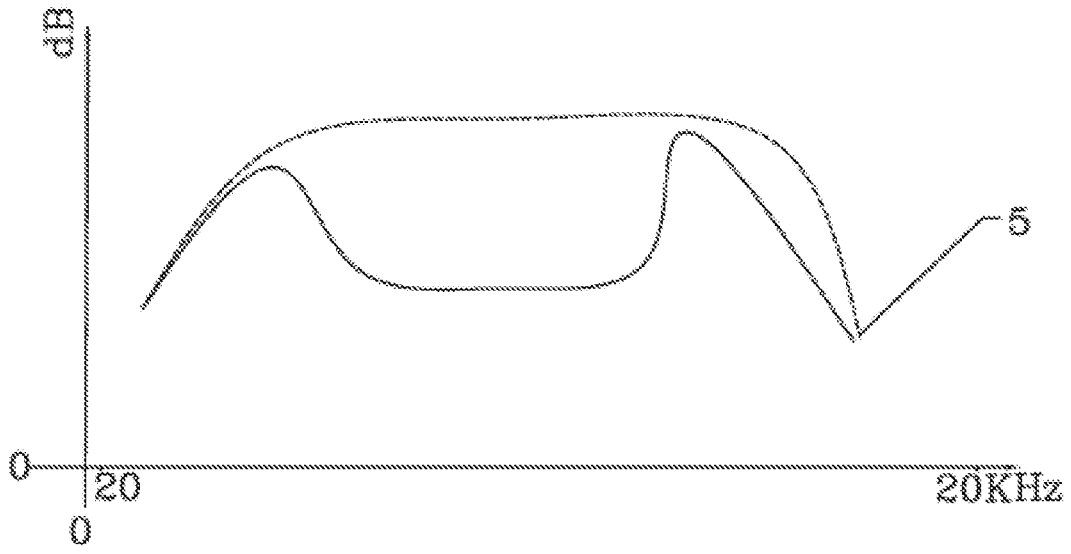
FIG. 5 illustrates a frequency response curves of the bone conduction speakers of the vibration device in the present disclosure.

Through the compound vibration device composed of the vibration board and the vibration conductive plate, a frequency response shown in FIG. 5 is achieved. The double compound vibration generates two resonance peaks, whose positions can be changed by adjusting the parameters including sizes and materials of the two vibration parts, making the resonance peak in low frequency area move to the lower frequency area and the peak in high frequency move higher, finally generates a frequency response curve as the dotted line shown in FIG. 5, which is a flat frequency response curve generated in an ideal condition, whose resonance peaks are among the frequencies catchable with human ears. Thus, the device widens the resonance oscillation ranges, and generates the ideal voices.

In some embodiments, the stiffness of the vibration board may be larger than that of the vibration conductive plate. In some embodiments, the resonance peaks of the frequency response curve may be set within a frequency range perceivable by human ears, or a frequency range that a person's ears may not hear. Preferably, the two resonance peaks may be beyond the frequency range that a person may hear. More preferably, one resonance peak may be within the frequency range perceivable by human ears, and another one may be beyond the frequency range that a person may hear. More preferably, the two resonance peaks may be within the frequency range perceivable by human ears. Further preferably, the two resonance peaks may be within the frequency range perceivable by human ears, and the peak frequency may be in a range of 80 Hz-18000 Hz. Further preferably, the two resonance peaks may be within the frequency range perceivable by human ears, and the peak frequency may be in a range of 200 Hz-15000 Hz. Further preferably, the two resonance peaks may be within the frequency range perceivable by human ears, and the peak frequency may be in a range of 500 Hz-12000 Hz. Further preferably, the two resonance peaks may be within the frequency range perceivable by human ears, and the peak frequency may be in a range of 800 Hz-11000 Hz. There may be a difference between the frequency values of the resonance peaks. For example, the difference between the frequency values of the two resonance peaks may be at least 500 Hz, preferably 1000 Hz, more preferably 2000 Hz, and more preferably 5000 Hz. To achieve a better effect, the two resonance peaks may be within the frequency range perceivable by human ears, and the difference between the frequency values of the two resonance peaks may be at least 500 Hz. Preferably, the two resonance peaks may be within the frequency range perceivable by human ears, and the difference between the frequency values of the two resonance peaks may be at least 1000 Hz. More preferably, the two resonance peaks may be within the frequency range perceivable by human ears, and the difference between the frequency values of the two resonance peaks may be at least 2000 Hz. More preferably, the two resonance peaks may be within the frequency range perceivable by human ears, and the difference between the frequency values of the two resonance peaks may be at least 3000 Hz. Moreover, more preferably, the two resonance peaks may be within the frequency range perceivable by human ears, and the difference between the frequency values of the two resonance peaks may be at least 4000 Hz. One resonance peak may be within the frequency range perceivable by human ears, another one may be beyond the frequency range that a person may hear, and the difference between the frequency values of the two resonance peaks may be at least 500 Hz. Preferably, one resonance peak may be within the frequency range perceivable by human ears, another one may be beyond the frequency range that a person may hear, and the difference between the frequency values of the two resonance peaks may be at least 1000 Hz. More preferably, one resonance peak may be within the frequency range perceivable by human ears, another one may be beyond the frequency range that a person may hear, and the difference between the frequency values of the two resonance peaks may be at least 2000 Hz. More preferably, one resonance peak may be within the frequency range perceivable by human ears, another one may be beyond the frequency range that a person may hear, and the difference between the frequency values of the two resonance peaks may be at least 3000 Hz. Moreover, more preferably, one resonance peak may be within the frequency range perceivable by human ears, another one may be beyond the frequency range that a person may hear, and the difference between the frequency values of the two resonance peaks may be at least 4000 Hz. Both resonance peaks may be within the frequency range of 5 Hz-30000 Hz, and the difference between the frequency values of the two resonance peaks may be at least 400 Hz. Preferably, both resonance peaks may be within the frequency range of 5 Hz-30000 Hz, and the difference between the frequency values of the two resonance peaks may be at least 1000 Hz. More preferably, both resonance peaks may be within the frequency range of 5 Hz-30000 Hz, and the difference between the frequency values of the two resonance peaks may be at least 2000 Hz. More preferably, both resonance peaks may be within the frequency range of 5 Hz-30000 Hz, and the difference between the frequency values of the two resonance peaks may be at least 3000 Hz. Moreover, further preferably, both resonance peaks may be within the frequency range of 5 Hz-30000 Hz, and the difference between the frequency values of the two resonance peaks may be at least 4000 Hz. Both resonance peaks may be within the frequency range of 20 Hz-20000 Hz, and the difference between the frequency values of the two resonance peaks may be at least 400 Hz. Preferably, both resonance peaks may be within the frequency range of 20 Hz-20000 Hz, and the difference between the frequency values of the two resonance peaks may be at least 1000 Hz. More preferably, both resonance peaks may be within the frequency range of 20 Hz-20000 Hz, and the difference between the frequency values of the two resonance peaks may be at least 2000 Hz. More preferably, both resonance peaks may be within the frequency range of 20 Hz-20000 Hz, and the difference between the frequency values of the two resonance peaks may be at least 3000 Hz. And further preferably, both resonance peaks may be within the frequency range of 20 Hz-20000 Hz, and the difference between the frequency values of the two resonance peaks may be at least 4000 Hz. Both the two resonance peaks may be within the frequency range of 100 Hz-18000 Hz, and the difference between the frequency values of the two resonance peaks may be at least 400 Hz. Preferably, both resonance peaks may be within the frequency range of 100 Hz-18000 Hz, and the difference between the frequency values of the two resonance peaks may be at least 1000 Hz. More preferably, both resonance peaks may be within the frequency range of 100 Hz-18000 Hz, and the difference between the frequency values of the two resonance peaks may be at least 2000 Hz. More preferably, both resonance peaks may be within the frequency range of 100 Hz-18000 Hz, and the difference between the frequency values of the two resonance peaks may be at least 3000 Hz. And further preferably, both resonance peaks may be within the frequency range of 100 Hz-18000 Hz, and the difference between the frequency values of the two resonance peaks may be at least 4000 Hz. Both the two resonance peaks may be within the frequency range of 200 Hz-12000 Hz, and the difference between the frequency values of the two resonance peaks may be at least 400 Hz. Preferably, both resonance peaks may be within the frequency range of 200 Hz-12000 Hz, and the difference between the frequency values of the two resonance peaks may be at least 1000 Hz. More preferably, both resonance peaks may be within the frequency range of 200 Hz-12000 Hz, and the difference between the frequency values of the two resonance peaks may be at least 2000 Hz. More preferably, both resonance peaks may be within the frequency range of 200 Hz-12000 Hz, and the difference between the frequency values of the two resonance peaks may be at least 3000 Hz. And further preferably, both resonance peaks may be within the frequency range of 200 Hz-12000 Hz, and the difference between the frequency values of the two resonance peaks may be at least 4000 Hz. Both the two resonance peaks may be within the frequency range of 500 Hz-10000 Hz, and the difference between the frequency values of the two resonance peaks may be at least 400 Hz. Preferably, both resonance peaks may be within the frequency range of 500 Hz-10000 Hz, and the difference between the frequency values of the two resonance peaks may be at least 1000 Hz. More preferably, both resonance peaks may be within the frequency range of 500 Hz-10000 Hz, and the difference between the frequency values of the two resonance peaks may be at least 2000 Hz. More preferably, both resonance peaks may be within the frequency range of 500 Hz-10000 Hz, and the difference between the frequency values of the two resonance peaks may be at least 3000 Hz. And further preferably, both resonance peaks may be within the frequency range of 500 Hz-10000 Hz, and the difference between the frequency values of the two resonance peaks may be at least 4000 Hz. This may broaden the range of the resonance response of the speaker, thus obtaining a more ideal sound quality. It should be noted that in actual applications, there may be multiple vibration conductive plates and vibration boards to form multi-layer vibration structures corresponding to different ranges of frequency response, thus obtaining diatonic, full-ranged and high-quality vibrations of the speaker, or may make the frequency response curve meet requirements in a specific frequency range. For example, to satisfy the requirement of normal hearing, a bone conduction hearing aid may be configured to have a transducer including one or more vibration boards and vibration conductive plates with a resonance frequency in a range of 100 Hz-10000 Hz.

In the better implement examples, but, not limited to these examples, it is adopted that, the vibration conductive plate can be made by stainless steels, with a thickness of 0.1-0.2 mm, and when the middle three rods of the first rods group in the vibration conductive plate have a width of 0.5-1.0 mm, the low frequency resonance oscillation peak of the bone conduction speaker is located between 300 and 900 Hz. And, when the three straight rods in the second rods group have a width between 1.6 and 2.6 mm, and a thickness between 0.8 and 1.2 mm, the high frequency resonance oscillation peak of the bone conduction speaker is between 7500 and 9500 Hz. Also, the structures of the vibration conductive plate and the vibration board is not limited to three straight rods, as long as their structures can make a suitable flexibility to both vibration conductive plate and vibration board, cross-shaped rods and other rod structures are also suitable. Of course, with more compound vibration parts, more resonance oscillation peaks will be achieved, and the fitting curve will be flatter and the sound wider. Thus, in the better implement examples, more than two vibration parts, including the vibration conductive plate and vibration board as well as similar parts, overlapping each other, is also applicable, just needs more costs.

Figure 7:
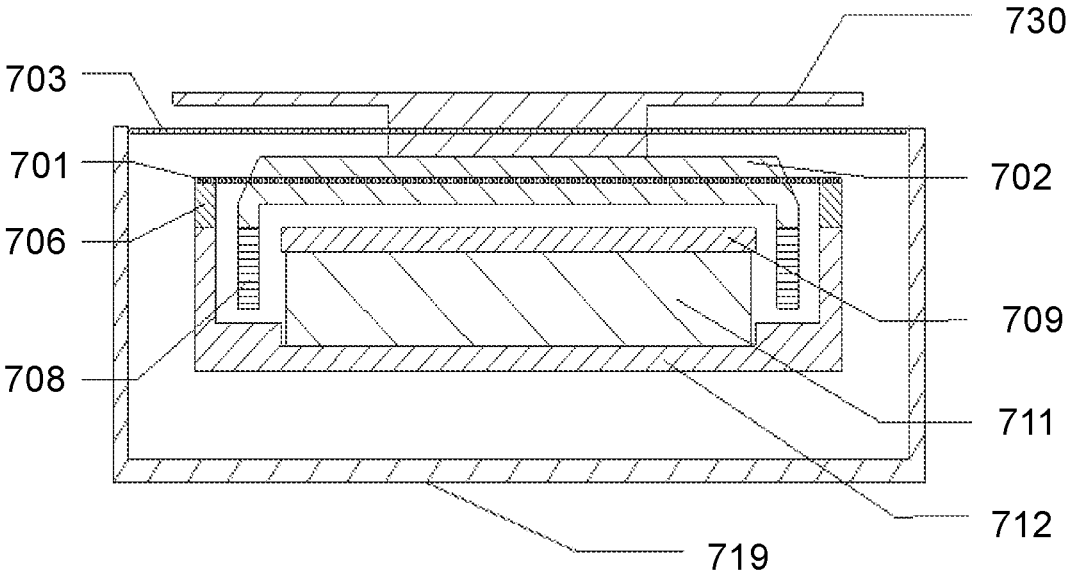
FIG. 7 illustrates a structure of the bone conduction speaker and the compound vibration device according to some embodiments of the present disclosure.

As shown in FIG. 7, in another embodiment, the compound vibration device (also referred to as "compound vibration system") may include a vibration board 702, a first vibration conductive plate 703, and a second vibration conductive plate 701. The first vibration conductive plate 703 may fix the vibration board 702 and the second vibration conductive plate 701 onto a housing 719. The compound vibration system including the vibration board 702, the first vibration conductive plate 703, and the second vibration conductive plate 701 may lead to no less than two resonance peaks and a smoother frequency response curve in the range of the auditory system, thus improving the sound quality of the bone conduction speaker. The equivalent model of the compound vibration system may be shown in FIG. 8-A:

For illustration purposes, 801 represents a housing, 802 represents a panel, 803 represents a voice coil, 804 represents a magnetic circuit system, 805 represents a first vibration conductive plate, 806 represents a second vibration conductive plate, and 807 represents a vibration board. The first vibration conductive plate, the second vibration conductive plate, and the vibration board may be abstracted as components with elasticity and damping; the housing, the panel, the voice coil and the magnetic circuit system may be abstracted as equivalent mass blocks. The vibration equation of the system may be expressed as:

$$m_6''x_6'' + R_6(x_6 - x_5)' + k_6(x_6 - x_5) = F, \tag{1}$$

$$x_7'' + R_7(x_7 - x_5)' + k_7(x_7 - x_5) = -F, \tag{2}$$

$$m_5x_5'' + R_6(x_6 - x_5)' - R_7(x_7 - x_5)' + R_8x_5' + k_8x_5 - k_6(x_6 - x_5) - k_7(x_7 - x_5) = 0, \tag{3}$$

wherein, F is a driving force, $k_6$ is an equivalent stiffness coefficient of the second vibration conductive plate, $k_7$ is an equivalent stiffness coefficient of the vibration board, $k_8$ is an equivalent stiffness coefficient of the first vibration conductive plate, $R_6$ is an equivalent damping of the second vibration conductive plate, $R_7$ is an equivalent damping of the vibration board, $R_8$ is an equivalent damp of the first vibration conductive plate, $m_5$ is a mass of the panel, $m_6$ is a mass of the magnetic circuit system, $m_7$ is a mass of the voice coil, $x_5$ is a displacement of the panel, $x_6$ is a displacement of the magnetic circuit system, $x_7$ is to displacement of the voice coil, and the amplitude of the panel 802 may be:

$$A_5 = \frac{\left(-m_6\omega^2(jR_7\omega - k_7) + m_7\omega^2(jR_6\omega - k_6)\right)}{\left(\begin{array}{c}\left(-m_5\omega^2 - jR_8\omega + k_8\right)\left(-m_6\omega^2 - jR_6\omega + k_6\right)\\ \left(-m_7\omega^2 - jR_7\omega + k_7\right) - \\ m_6\omega^2(-jR_6\omega + k_6)\left(-m_7\omega^2 - jR_7\omega + k_7\right) - \\ m_7\omega^2(-jR_7\omega + k_7)\left(-m_6\omega^2 - jR_6\omega + k_6\right)\end{array}\right)} f_0, \tag{4}$$

wherein $\omega$ is an angular frequency of the vibration, and $f_0$ is a unit driving force.

The vibration system of the bone conduction speaker may transfer vibrations to a user via a panel (e.g., the panel 730 shown in FIG. 7). According to the equation (4), the vibration efficiency may relate to the stiffness coefficients of the vibration board, the first vibration conductive plate, and the second vibration conductive plate, and the vibration damping. Preferably, the stiffness coefficient of the vibration board $k_7$ may be greater than the second vibration coefficient $k_6$, and the stiffness coefficient of the vibration board $k_7$ may be greater than the first vibration factor $k_8$. The number of resonance peaks generated by the compound vibration system with the first vibration conductive plate may be more than the compound vibration system without the first vibration conductive plate, preferably at least three resonance peaks. More preferably, at least one resonance peak may be beyond the range perceivable by human ears. More preferably, the resonance peaks may be within the range perceivable by human ears. More further preferably, the resonance peaks may be within the range perceivable by human ears, and the frequency peak value may be no more than 18000 Hz. More preferably, the resonance peaks may be within the range perceivable by human ears, and the frequency peak value may be within the frequency range of 100 Hz-15000 Hz. More preferably, the resonance peaks may be within the range perceivable by human ears, and the frequency peak value may be within the frequency range of 200 Hz-12000 Hz. More preferably, the resonance peaks may be within the range perceivable by human ears, and the frequency peak value may be within the frequency range of 500 Hz-11000 Hz. There may be differences between the frequency values of the resonance peaks. For example, there may be at least two resonance peaks with a difference of the frequency values between the two resonance peaks no less than 200 Hz. Preferably, there may be at least two resonance peaks with a difference of the frequency values between the two resonance peaks no less than 500 Hz. More preferably, there may be at least two resonance peaks with a difference of the frequency values between the two resonance peaks no less than 1000 Hz. More preferably, there may be at least two resonance peaks with a difference of the frequency values between the two resonance peaks no less than 2000 Hz. More preferably, there may be at least two resonance peaks with a difference of the frequency values between the two resonance peaks no less than 5000 Hz. To achieve a better effect, all of the resonance peaks may be within the range perceivable by human ears, and there may be at least two resonance peaks with a difference of the frequency values between the two resonance peaks no less than 500 Hz. Preferably, all of the resonance peaks may be within the range perceivable by human ears, and there may be at least two resonance peaks with a difference of the frequency values between the two resonance peaks no less than 1000 Hz. More preferably, all of the resonance peaks may be within the range perceivable by human ears, and there may be at least two resonance peaks with a difference of the frequency values between the two resonance peaks no less than 2000 Hz. More preferably, all of the resonance peaks may be within the range perceivable by human ears, and there may be at least two resonance peaks with a difference of the frequency values between the two resonance peaks no less than 3000 Hz. More preferably, all of the resonance peaks may be within the range perceivable by human ears, and there may be at least two resonance peaks with a difference of the frequency values between the two resonance peaks no less than 4000 Hz. Two of the three resonance peaks may be within the frequency range perceivable by human ears, and another one may be beyond the frequency range that a person may hear, and there may be at least two resonance peaks with a difference of the frequency values between the two resonance peaks no less than 500 Hz. Preferably, two of the three resonance peaks may be within the frequency range perceivable by human ears, and another one may be beyond the frequency range that a person may hear, and there may be at least two resonance peaks with a difference of the frequency values between the two resonance peaks no less than 1000 Hz. More preferably, two of the three resonance peaks may be within the frequency range perceivable by human ears, and another one may be beyond the frequency range that a person may hear, and there may be at least two resonance peaks with a difference of the frequency values between the two resonance peaks no less than 2000 Hz. More preferably, two of the three resonance peaks may be within the frequency range perceivable by human ears, and another one may be beyond the frequency range that a person may hear, and there may be at least two resonance peaks with a difference of the frequency values between the two resonance peaks no less than 3000 Hz. More preferably, two of the three resonance peaks may be within the frequency range perceivable by human ears, and another one may be beyond the frequency range that a person may hear, and there may be at least two resonance peaks with a difference of the frequency values between the two resonance peaks no less than 4000 Hz. One of the three resonance peaks may be within the frequency range perceivable by human ears, and the other two may be beyond the frequency range that a person may hear, and there may be at least two resonance peaks with a difference of the frequency values between the two resonance peaks no less than 500 Hz. Preferably, one of the three resonance peaks may be within the frequency range perceivable by human ears, and the other two may be beyond the frequency range that a person may hear, and there may be at least two resonance peaks with a difference of the frequency values between the two resonance peaks no less than 1000 Hz. More preferably, one of the three resonance peaks may be within the frequency range perceivable by human ears, and the other two may be beyond the frequency range that a person may hear, and there may be at least two resonance peaks with a difference of the frequency values between the two resonance peaks no less than 2000 Hz. More preferably, one of the three resonance peaks may be within the frequency range perceivable by human ears, and the other two may be beyond the frequency range that a person may hear, and there may be at least two resonance peaks with a difference of the frequency values between the two resonance peaks no less than 3000 Hz. More preferably, one of the three resonance peaks may be within the frequency range perceivable by human ears, and the other two may be beyond the frequency range that a person may hear, and there may be at least two resonance peaks with a difference of the frequency values between the two resonance peaks no less than 4000 Hz. All the resonance peaks may be within the frequency range of 5 Hz-30000 Hz, and there may be at least two resonance peaks with a difference of the frequency values between the two resonance peaks of at least 400 Hz. Preferably, all the resonance peaks may be within the frequency range of 5 Hz-30000 Hz, and there may be at least two resonance peaks with a difference of the frequency values between the two resonance peaks of at least 1000 Hz. More preferably, all the resonance peaks may be within the frequency range of 5 Hz-30000 Hz, and there may be at least two resonance peaks with a difference of the frequency values between the two resonance peaks of at least 2000 Hz. More preferably, all the resonance peaks may be within the frequency range of 5 Hz-30000 Hz, and there may be at least two resonance peaks with a difference of the frequency values between the two resonance peaks of at least 3000 Hz. And further preferably, all the resonance peaks may be within the frequency range of 5 Hz-30000 Hz, and there may be at least two resonance peaks with a difference of the frequency values between the two resonance peaks of at least 4000 Hz. All the resonance peaks may be within the frequency range of 20 Hz-20000 Hz, and there may be at least two resonance peaks with a difference of the frequency values between the two resonance peaks of at least 400 Hz. Preferably, all the resonance peaks may be within the frequency range of 20 Hz-20000 Hz, and there may be at least two resonance peaks with a difference of the frequency values between the two resonance peaks of at least 1000 Hz. More preferably, all the resonance peaks may be within the frequency range of 20 Hz-20000 Hz, and there may be at least two resonance peaks with a difference of the frequency values between the two resonance peaks of at least 2000 Hz. More preferably, all the resonance peaks may be within the frequency range of 20 Hz-20000 Hz, and there may be at least two resonance peaks with a difference of the frequency values between the two resonance peaks of at least 3000 Hz. And further preferably, all the resonance peaks may be within the frequency range of 20 Hz-20000 Hz, and there may be at least two resonance peaks with a difference of the frequency values between the two resonance peaks of at least 4000 Hz. All the resonance peaks may be within the frequency range of 100 Hz-18000 Hz, and there may be at least two resonance peaks with a difference of the frequency values between the two resonance peaks of at least 400 Hz. Preferably, all the resonance peaks may be within the frequency range of 100 Hz-18000 Hz, and there may be at least two resonance peaks with a difference of the frequency values between the two resonance peaks of at least 1000 Hz. More preferably, all the resonance peaks may be within the frequency range of 100 Hz-18000 Hz, and there may be at least two resonance peaks with a difference of the frequency values between the two resonance peaks of at least 2000 Hz. More preferably, all the resonance peaks may be within the frequency range of 100 Hz-18000 Hz, and there may be at least two resonance peaks with a difference of the frequency values between the two resonance peaks of at least 3000 Hz. And further preferably, all the resonance peaks may be within the frequency range of 100 Hz-18000 Hz, and there may be at least two resonance peaks with a difference of the frequency values between the two resonance peaks of at least 4000 Hz. All the resonance peaks may be within the frequency range of 200 Hz-12000 Hz, and there may be at least two resonance peaks with a difference of the frequency values between the two resonance peaks of at least 400 Hz. Preferably, all the resonance peaks may be within the frequency range of 200 Hz-12000 Hz, and there may be at least two resonance peaks with a difference of the frequency values between the two resonance peaks of at least 1000 Hz. More preferably, all the resonance peaks may be within the frequency range of 200 Hz-12000 Hz, and there may be at least two resonance peaks with a difference of the frequency values between the two resonance peaks of at least 2000 Hz. More preferably, all the resonance peaks may be within the frequency range of 200 Hz-12000 Hz, and there may be at least two resonance peaks with a difference of the frequency values between the two resonance peaks of at least 3000 Hz. And further preferably, all the resonance peaks may be within the frequency range of 200 Hz-12000 Hz, and there may be at least two resonance peaks with a difference of the frequency values between the two resonance peaks of at least 4000 Hz. All the resonance peaks may be within the frequency range of 500 Hz-10000 Hz, and there may be at least two resonance peaks with a difference of the frequency values between the two resonance peaks of at least 400 Hz. Preferably, all the resonance peaks may be within the frequency range of 500 Hz-10000 Hz, and there may be at least two resonance peaks with a difference of the frequency values between the two resonance peaks of at least 1000 Hz. More preferably, all the resonance peaks may be within the frequency range of 500 Hz-10000 Hz, and there may be at least two resonance peaks with a difference of the frequency values between the two resonance peaks of at least 2000 Hz. More preferably, all the resonance peaks may be within the frequency range of 500 Hz-10000 Hz, and there may be at least two resonance peaks with a difference of the frequency values between the two resonance peaks of at least 3000 Hz. Moreover, further preferably, all the resonance peaks may be within the frequency range of 500 Hz-10000 Hz, and there may be at least two resonance peaks with a difference of the frequency values between the two resonance peaks of at least 4000 Hz. In one embodiment, the compound vibration system including the vibration board, the first vibration conductive plate, and the second vibration conductive plate may generate a frequency response as shown in FIG. 8-B. The compound vibration system with the first vibration conductive plate may generate three obvious resonance peaks, which may improve the sensitivity of the frequency response in the low-frequency range (about 600 Hz), obtain a smoother frequency response, and improve the sound quality.

The resonance peak may be shifted by changing a parameter of the first vibration conductive plate, such as the size and material, so as to obtain an ideal frequency response eventually. For example, the stiffness coefficient of the first vibration conductive plate may be reduced to a designed value, causing the resonance peak to move to a designed low frequency, thus enhancing the sensitivity of the bone conduction speaker in the low frequency, and improving the quality of the sound. As shown in FIG. 8-C, as the stiffness coefficient of the first vibration conductive plate decreases (i.e., the first vibration conductive plate becomes softer), the resonance peak moves to the low frequency region, and the sensitivity of the frequency response of the bone conduction speaker in the low frequency region gets improved. Preferably, the first vibration conductive plate may be an elastic plate, and the elasticity may be determined based on the material, thickness, structure, or the like. The material of the first vibration conductive plate may include but not limited to steel (for example but not limited to, stainless steel, carbon steel, etc.), light alloy (for example but not limited to, aluminum, beryllium copper, magnesium alloy, titanium alloy, etc.), plastic (for example but not limited to, polyethylene, nylon blow molding, plastic, etc.). It may be a single material or a composite material that achieve the same performance. The composite material may include but not limited to reinforced material, such as glass fiber, carbon fiber, boron fiber, graphite fiber, graphene fiber, silicon carbide fiber, aramid fiber, or the like. The composite material may also be other organic and/or inorganic composite materials, such as various types of glass fiber reinforced by unsaturated polyester and epoxy, fiberglass comprising phenolic resin matrix. The thickness of the first vibration conductive plate may be not less than 0.005 mm. Preferably, the thickness may be 0.005 mm-3 mm. More preferably, the thickness may be 0.01 mm-2 mm. More preferably, the thickness may be 0.01 mm-1 mm. Moreover, further preferably, the thickness may be 0.02 mm-0.5 mm. The first vibration conductive plate may have an annular structure, preferably including at least one annular ring, preferably, including at least two annular rings. The annular ring may be a concentric ring or a non-concentric ring and may be connected to each other via at least two rods converging from the outer ring to the center of the inner ring. More preferably, there may be at least one oval ring. More preferably, there may be at least two oval rings. Different oval rings may have different curvatures radiuses, and the oval rings may be connected to each other via rods. Further preferably, there may be at least one square ring. The first vibration conductive plate may also have the shape of a plate. Preferably, a hollow pattern may be configured on the plate. Moreover, more preferably, the area of the hollow pattern may be not less than the area of the non-hollow portion. It should be noted that the above-described material, structure, or thickness may be combined in any manner to obtain different vibration conductive plates. For example, the annular vibration conductive plate may have a different thickness distribution. Preferably, the thickness of the ring may be equal to the thickness of the rod. Further preferably, the thickness of the rod may be larger than the thickness of the ring. Moreover, still, further preferably, the thickness of the inner ring may be larger than the thickness of the outer ring.

When the compound vibration device is applied to the bone conduction speaker, the major applicable area is bone conduction earphones. Thus the bone conduction speaker adopting the structure will be fallen into the protection of the present disclosure.

The bone conduction speaker and its compound vibration device stated in the present disclosure, make the technique simpler with a lower cost. Because the two parts in the compound vibration device can adjust the low frequency as well as the high frequency ranges, as shown in FIG. 5, which makes the achieved frequency response flatter, and voice more broader, avoiding the problem of abrupt frequency response and feeble voices caused by single vibration device, thus broaden the application prospection of bone conduction speaker.

Figure 4:
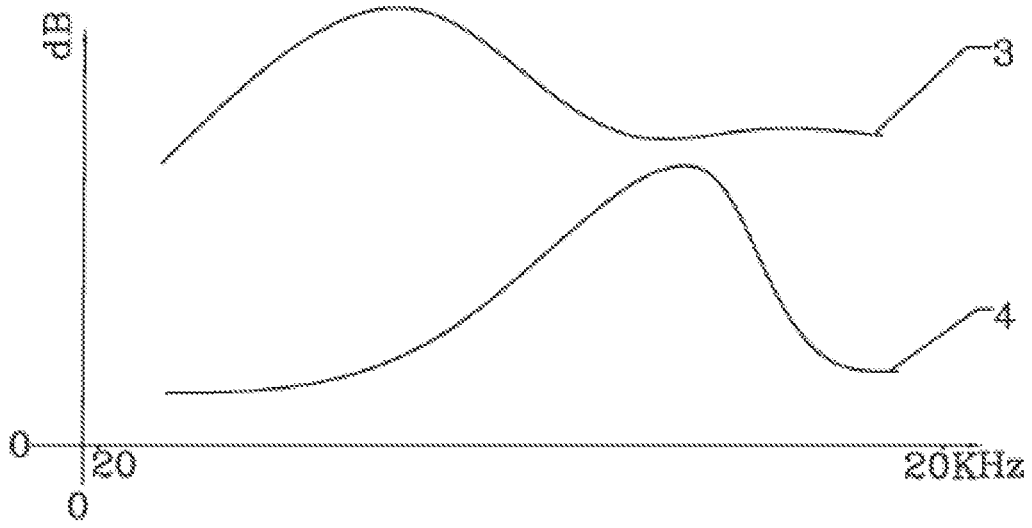
FIG. 4 illustrates a frequency response curves of the bone conduction speakers of vibration device in the prior art.

In the prior art, the vibration parts did not take full account of the effects of every part to the frequency response, thus, although they could have the similar outlooks with the products described in the present disclosure, they will generate an abrupt frequency response, or feeble sound. And due to the improper matching between different parts, the resonance peak could have exceeded the human hearable range, which is between 20 Hz and 20 KHz. Thus, only one sharp resonance peak as shown in FIG. 4 appears, which means a pretty poor tone quality.

It should be made clear that, the above detailed description of the better implement examples should not be considered as the limitations to the present disclosure protections. The extent of the patent protection of the present disclosure should be determined by the terms of claims.

EXAMPLES

Example 1

A bone conduction speaker may include a U-shaped headset bracket/headset lanyard, two vibration units, a transducer connected to each vibration unit. The vibration unit may include a contact surface and a housing. The contact surface may be an outer surface of a silicone rubber transfer layer and may be configured to have a gradient structure including a convex portion. A clamping force between the contact surface and skin due to the headset bracket/headset lanyard may be unevenly distributed on the contact surface. The sound transfer efficiency of the portion of the gradient structure may be different from the portion without the gradient structure.

Example 2

This example may be different from Example 1 in the following aspects. The headset bracket/headset lanyard as described may include a memory alloy. The headset bracket/headset lanyard may match the curves of different users' heads and have a good elasticity and a better wearing comfort. The headset bracket/headset lanyard may recover to its original shape from a deformed status last for a certain period. As used herein, the certain period may refer to ten minutes, thirty minutes, one hour, two hours, five hours, or may also refer to one day, two days, ten days, one month, one year, or a longer period. The clamping force that the headset bracket/headset lanyard provides may keep stable, and may not decline gradually over time. The force intensity between the bone conduction speaker and the body surface of a user may be within an appropriate range, so as to avoid pain or clear vibration sense caused by undue force when the user wears the bone conduction speaker. Moreover, the clamping force of bone conduction speaker may be within a range of 0.2N~1.5N when the bone conduction speaker is used.

Example 3

The difference between this example and the two examples mentioned above may include the following aspects. The elastic coefficient of the headset bracket/headset lanyard may be kept in a specific range, which results in the value of the frequency response curve in low frequency (e.g., under 500 Hz) being higher than the value of the frequency response curve in high frequency (e.g., above 4000 Hz).

Example 4

The difference between Example 4 and Example 1 may include the following aspects. The bone conduction speaker may be mounted on an eyeglass frame, or in a helmet or mask with a special function.

Example 5

The difference between this example and Example 1 may include the following aspects. The vibration unit may include two or more panels, and the different panels or the vibration transfer layers connected to the different panels may have different gradient structures on a contact surface being in contact with a user. For example, one contact surface may have a convex portion, the other one may have a concave structure, or the gradient structures on both the two contact surfaces may be convex portions or concave structures, but there may be at least one difference between the shape or the number of the convex portions.

Example 6

A portable bone conduction hearing aid may include multiple frequency response curves. A user or a tester may choose a proper response curve for hearing compensation according to an actual response curve of the auditory system of a person. In addition, according to an actual requirement, a vibration unit in the bone conduction hearing aid may enable the bone conduction hearing aid to generate an ideal frequency response in a specific frequency range, such as 500 Hz-4000 Hz.

Example 7

A vibration generation portion of a bone conduction speaker may be shown in FIG. 9-A. A transducer of the bone conduction speaker may include a magnetic circuit system including a magnetic flux conduction plate 910, a magnet 911 and a magnetizer 912, a vibration board 914, a coil 915, a first vibration conductive plate 916, and a second vibration conductive plate 917. The panel 913 may protrude out of the housing 919 and may be connected to the vibration board 914 by glue. The transducer may be fixed to the housing 919 via the first vibration conductive plate 916 forming a suspended structure.

A compound vibration system including the vibration board 914, the first vibration conductive plate 916, and the second vibration conductive plate 917 may generate a smoother frequency response curve, so as to improve the sound quality of the bone conduction speaker. The transducer may be fixed to the housing 919 via the first vibration conductive plate 916 to reduce the vibration that the transducer is transferring to the housing, thus effectively decreasing sound leakage caused by the vibration of the housing, and reducing the effect of the vibration of the housing on the sound quality. FIG. 9-B shows frequency response curves of the vibration intensities of the housing of the vibration generation portion and the panel. The bold line refers to the frequency response of the vibration generation portion including the first vibration conductive plate 916, and the thin line refers to the frequency response of the vibration generation portion without the first vibration conductive plate 916. As shown in FIG. 9-B, the vibration intensity of the housing of the bone conduction speaker without the first vibration conductive plate may be larger than that of the bone conduction speaker with the first vibration conductive plate when the frequency is higher than 500 Hz. FIG. 9-C shows a comparison of the sound leakage between a bone conduction speaker includes the first vibration conductive plate 916 and another bone conduction speaker does not include the first vibration conductive plate 916. The sound leakage when the bone conduction speaker includes the first vibration conductive plate may be smaller than the sound leakage when the bone conduction speaker does not include the first vibration conductive plate in the intermediate frequency range (for example, about 1000 Hz). It can be concluded that the use of the first vibration conductive plate between the panel and the housing may effectively reduce the vibration of the housing, thereby reducing the sound leakage.

The first vibration conductive plate may be made of the material, for example but not limited to stainless steel, copper, plastic, polycarbonate, or the like, and the thickness may be in a range of 0.01 mm-1 mm.

Example 8

Figure 10:
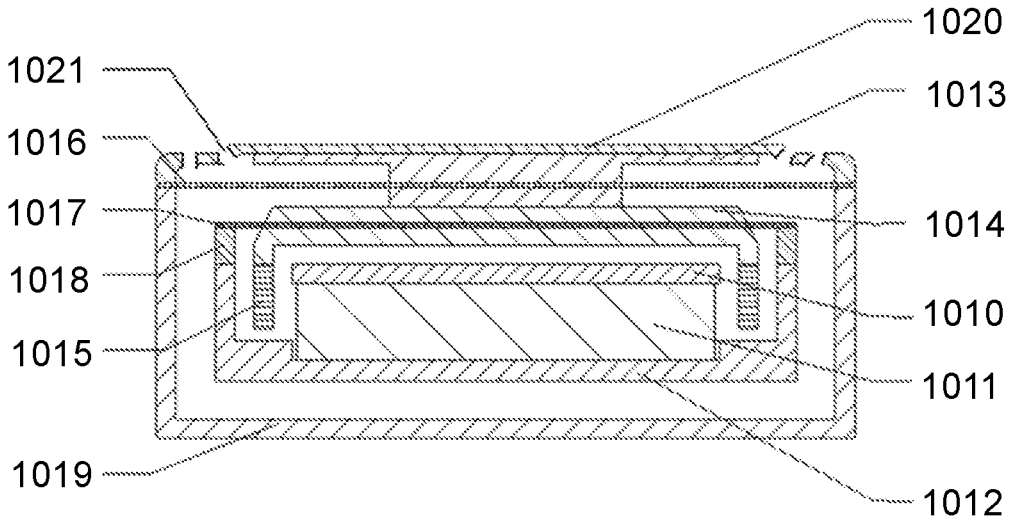
FIG. 10 illustrates a structure of the vibration generation portion of the bone conduction speaker according to one specific embodiment of the present disclosure.

This example may be different with Example 7 in the following aspects. As shown in FIG. 10, the panel 1013 may be configured to have a vibration transfer layer 1020 (for example but not limited to, silicone rubber) to produce a certain deformation to match a user's skin. A contact portion being in contact with the panel 1013 on the vibration transfer layer 1020 may be higher than a portion not being in contact with the panel 1013 on the vibration transfer layer 1020 to form a step structure. The portion not being in contact with the panel 1013 on the vibration transfer layer 1020 may be configured to have one or more holes 1021. The holes on the vibration transfer layer may reduce the sound leakage: the connection between the panel 1013 and the housing 1019 via the vibration transfer layer 1020 may be weakened, and vibration transferred from panel 1013 to the housing 1019 via the vibration transfer layer 1020 may be reduced, thereby reducing the sound leakage caused by the vibration of the housing; the area of the vibration transfer layer 1020 configured to have holes on the portion without protrusion may be reduced, thereby reducing air and sound leakage caused by the vibration of the air; the vibration of air in the housing may be guided out, interfering with the vibration of air caused by the housing 1019, thereby reducing the sound leakage.

Example 9

The difference between this example and Example 7 may include the following aspects. As the panel may protrude out of the housing, meanwhile, the panel may be connected to the housing via the first vibration conductive plate, the degree of coupling between the panel and the housing may be dramatically reduced, and the panel may be in contact with a user with a higher freedom to adapt complex contact surfaces (as shown in the right figure of FIG. 11-A) as the first vibration conductive plate provides a certain amount of deformation. The first vibration conductive plate may incline the panel relative to the housing with a certain angle. Preferably, the slope angle may not exceed 5 degrees.

The vibration efficiency may differ with contacting statuses. A better contacting status may lead to a higher vibration transfer efficiency. As shown in FIG. 11-B, the bold line shows the vibration transfer efficiency with a better contacting status, and the thin line shows a worse contacting status. It may be concluded that the better contacting status may correspond to a higher vibration transfer efficiency.

Example 10

Figure 12:
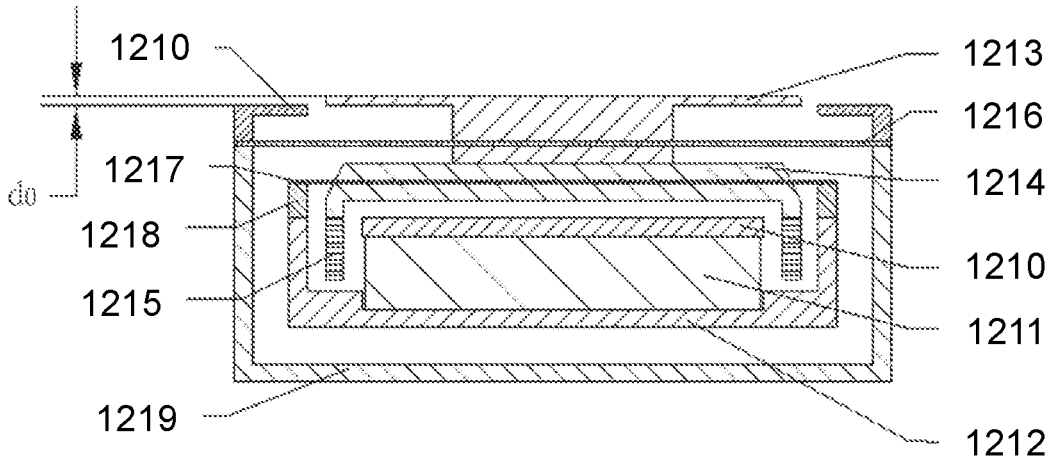
FIG. 12 illustrates a structure of the vibration generation portion of the bone conduction speaker according to one specific embodiment of the present disclosure.

The difference between this example and Example 7 may include the following aspects. A boarder may be added to surround the housing. When the housing contact with a user's skin, the surrounding boarder may facilitate an even distribution of an applied force, and improve the user's wearing comfort. As shown in FIG. 12, there may be a height difference do between the surrounding border 1210 and the panel 1213. The force from the skin to the panel 1213 may decrease the distanced between the panel 1213 and the surrounding border 1210. When the force between the bone conduction speaker and the user is larger than the force applied to the first vibration conductive plate with a deformation of do, the extra force may be transferred to the user's skin via the surrounding border 1210, without influencing the clamping force of the vibration portion, with the consistency of the clamping force improved, thereby ensuring the sound quality.

Example 11

Figure 13:
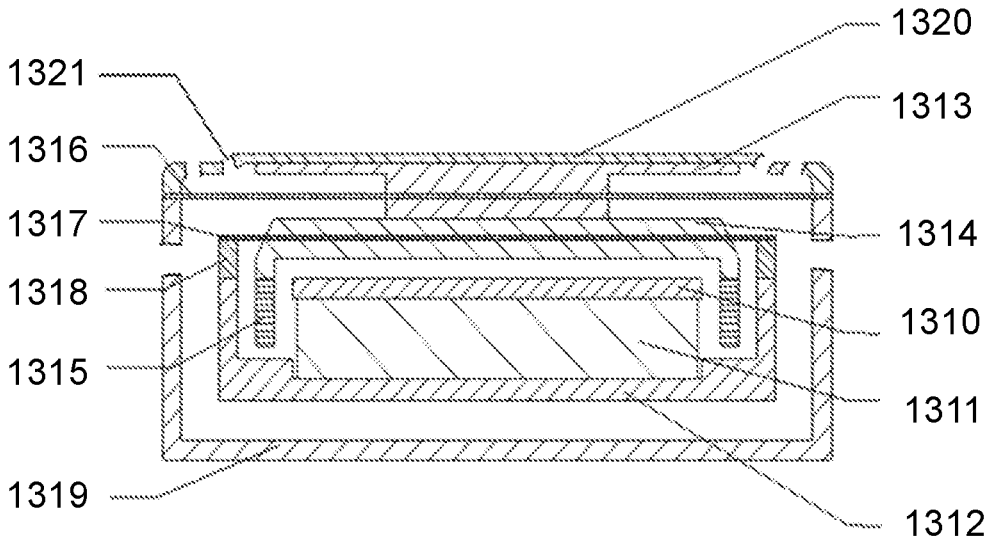
FIG. 13 illustrates a structure of the vibration generation portion of the bone conduction speaker according to one specific embodiment of the present disclosure.

The difference between this example and Example 8 may include the following aspects. As shown in FIG. 13, sound guiding holes are located at the vibration transfer layer 1320 and the housing 1319, respectively. The acoustic wave formed by the vibration of the air in the housing is guided to the outside of the housing, and interferes with the leaked acoustic wave due to the vibration of the air out of the housing, thus reducing the sound leakage.

Figure 14:
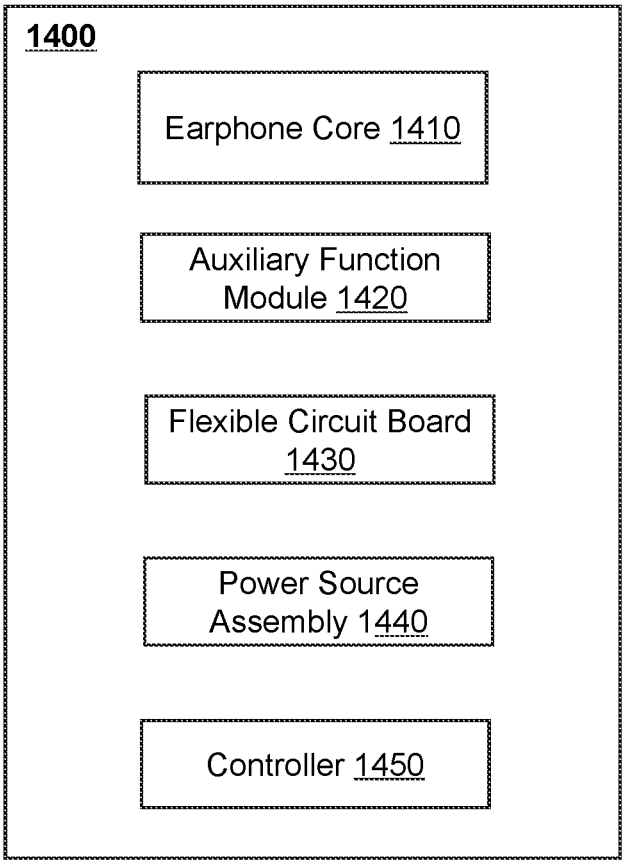
FIG. 14 is a schematic diagram illustrating exemplary components in a speaker according to some embodiments of the present disclosure.

FIG. 14 is a schematic diagram illustrating components in a speaker 1400 (e.g., the bone conduction speaker as described elsewhere in the present disclosure or an air conduction speaker) according to some embodiments of the present disclosure. As shown in FIG. 14, the speaker 1400 may include at least one of an earphone core 1410 (e.g., the transducer or a at least a portion of the compound vibration device described elsewhere in the present disclosure), an auxiliary function module 1420, a flexible circuit board 1430, a power source assembly 1440, a controller 1450, or the like.

The earphone core 1410 may be configured to process signals containing audio information, and convert the signals into sound signals. The audio information may include video or audio files with a specific data format, or data or files that may be converted into sound in a specific manner. The signals containing the audio information may include electrical signals, optical signals, magnetic signals, mechanical signals or the like, or any combination thereof. The processing operation may include frequency division, filtering, denoising, amplification, smoothing, or the like, or any combination thereof. The conversion may involve a coexistence and interconversion of energy of different types. For example, the electrical signal may be converted into mechanical vibrations that generates sound through the earphone core 1410 directly. As another example, the audio information may be included in the optical signal, and a specific earphone core may implement a process of converting the optical signal into a vibration signal. Energy of other types that may coexist and interconvert to each other during the working process of the earphone core 1410 may include thermal energy, magnetic field energy, or the like.

In some embodiments, the earphone core 1410 may include one or more acoustic drivers. The acoustic driver(s) may be used to convert electrical signals into sound for playback. For example, each of the acoustic driver(s) may include a transducer as described elsewhere in the present disclosure.

The auxiliary function module 1420 may be configured to receive auxiliary signals and execute auxiliary functions. The auxiliary function module 1420 may include one or more microphones (e.g., for detecting external sound), button modules, Bluetooth modules (e.g., for connecting the speaker 1400 to other devices (e.g., a user terminal of a user)), sensors, or the like, or any combination thereof. The auxiliary signals may include status signals (e.g., on, off, hibernation, connection, etc.) of the auxiliary function module 1420, signals generated through user operations (e.g., input and output signals generated by the user through keys, voice input, etc.), signals in the environment (e.g., audio signals in the environment), or the like, or any combination thereof. In some embodiments, the auxiliary function module 1420 may transmit the received auxiliary signals through the flexible circuit board 1430 to the other components in the speaker 1400 for processing.

A button module may be configured to control the speaker 1400, so as to implement the interaction between the user and the speaker 1400. The user may send a command to the speaker 1400 through the button module to control the operation of the speaker 1400. In some embodiments, the button module may include a power button, a playback control button, a sound adjustment button, a telephone control button, a recording button, a noise reduction button, a Bluetooth button, a return button, or the like, or any combination thereof. The power button may be configured to control the status (on, off, hibernation, or the like) of the power source assembly 1440. The playback control button may be configured to control sound playback by the earphone core 1410, for example, playing information, pausing information, continuing to play information, playing a previous item, playing a next item, mode selection (e.g., a sport mode, a working mode, an entertainment mode, a stereo mode, a folk mode, a rock mode, a bass mode, etc.), playing environment selection (e.g., indoor, outdoor, etc.), or the like, or any combination thereof. The sound adjustment button may be configured to control a sound amplitude of the earphone core 1410, for example, increasing the sound, decreasing the sound, or the like. The telephone control button may be configured to control telephone answering, rejection, hanging up, dialing back, holding, and/or recording incoming calls. The record button may be configured to record and store the audio information. The noise reduction button may be configured to select a degree of noise reduction. For example, the user may select a level or degree of noise reduction manually, or the speaker 1400 may select a level or degree of noise reduction automatically according to a playback mode selected by the user or detected ambient sound. The Bluetooth button may be configured to turn on Bluetooth, turn off Bluetooth, match Bluetooth, connect Bluetooth, or the like, or any combination thereof. The return button may be configured to return to a previous menu, interface, or the like.

A sensor may be configured to detect information related to the speaker 1400. For example, the sensor may be configured to detect the user's fingerprint, and transmit the detected fingerprint to the controller 1450. The controller 1450 may match the received fingerprint with a fingerprint pre-stored in the speaker 1400. If the matching is successful, the controller 1450 may generate an instruction that may be transmitted to each component to initiate the speaker 1400. As another example, the sensor may be configured to detect the position of the speaker 1400. When the sensor detects that the speaker 1400 is detached from a user's face, the sensor may transmit the detected information to the controller 1450, and the controller 1450 may generate an instruction to pause or stop the playback of the speaker 1400. In some embodiments, exemplary sensors may include a ranging sensor (e.g., an infrared ranging sensor, a laser ranging sensor, etc.), a speed sensor, a gyroscope, an accelerometer, a positioning sensor, a displacement sensor, a pressure sensor, a gas sensor, a light sensor, a temperature sensor, a humidity sensor, a fingerprint sensor, an iris sensor, an image sensor (e.g., a vidicon, a camera, etc.), or the like, or any combination thereof.

The flexible circuit board 1430 may be configured to connect different components in the speaker 1400. The flexible circuit board 1430 may be a flexible printed circuit (FPC). In some embodiments, the flexible circuit board 1430 may include one or more bonding pads and/or one or more flexible wires. The one or more bonding pads may be configured to connect the one or more components of the speaker 1400 or other bonding pads. The one or more flexible wires may be configured to connect the components of the speaker 1400 with one bonding pad, two or more bonding pads, or the like. In some embodiments, the flexible circuit board 1430 may include one or more flexible circuit boards. Merely by ways of example, the flexible circuit board 1430 may include a first flexible circuit board and a second flexible circuit board. The first flexible circuit board may be configured to connect two or more of the microphone, the earphone core 1410, and the controller 1450. The second flexible circuit board may be configured to connect two or more of the power source assembly 1440, the earphone core 1410, the controller 1450, or the like. In some embodiments, the flexible circuit board 1430 may be an integral structure including one or more regions. For example, the flexible circuit board 1430 may include a first region and a second region. The first region may be provided with flexible wires for connecting the bonding pads on the flexible circuit board 1430 and other components on the speaker 1400. The second region may be configured to set one or more bonding pads. In some embodiments, the power source assembly 1440 and/or the auxiliary function module 1420 may be connected to the flexible circuit board 1430 (e.g., the bonding pads) through the flexible wires of the flexible circuit board 1430. More details of the flexible circuit board 1430 may be disclosed elsewhere in the present disclosure, for example, FIG. 15 and the descriptions thereof.

The power source assembly 1440 may be configured to provide electrical power to the components of the speaker 1400. In some embodiments, the power source assembly 1440 may include a flexible circuit board, a battery, etc. The flexible circuit board may be configured to connect the battery and other components of the speaker 1400 (e.g., the earphone core 1410), and provide power for operations of the other components. In some embodiments, the power source assembly 1440 may also transmit its state information to the controller 1450 and receive instructions from the controller 1450 to perform corresponding operations. The state information of the power source assembly 1440 may include an on/off state, state of charge, time for use, a charging time, or the like, or any combination thereof.

According to information of the one or more components of the speaker 1400, the controller 1450 may generate an instruction to control the power source assembly 1440. For example, the controller 1450 may generate control instructions to control the power source assembly 1440 to provide power to the earphone core 1410 for generating sound. As another example, when the speaker 1400 does not receive input information within a certain time, the controller 1450 may generate a control instruction to control the power source assembly 1440 to enter a hibernation state. In some embodiments, the power source assembly 1440 may include a storage battery, a dry battery, a lithium battery, a Daniel battery, a fuel battery, or any combination thereof.

Merely by way of example, the controller 1450 may receive a sound signal from the user, for example, "play a song", from the auxiliary function module 1420. By processing the sound signal, the controller 1450 may generate control instructions related to the sound signal. For example, the control instructions may control the earphone core 1410 to obtain information of songs from a storage module of the speaker 1400 (or other devices). Then an electric signal for controlling the vibration of the earphone core 1410 may be generated according to the information.

In some embodiments, the controller 1450 may include one or more electronic frequency division modules. The electronic frequency division modules may divide a frequency of a source signal. The source signal may come from one or more sound source apparatus (e.g., a memory storing audio data) integrated in the speaker 1400. The source signal may also be an audio signal (e.g., an audio signal received from the auxiliary function module 1420) received by the speaker 1400 in a wired or wireless manner. In some embodiments, the electronic frequency division modules may decompose an input source signal into two or more frequency-divided signals containing different frequencies. For example, the electronic frequency division module may decompose the source signal into a first frequency-divided signal with high-frequency sound and a second frequency-divided signal with low-frequency sound. Signals processed by the electronic frequency division modules may be transmitted to the earphone core 1410 in a wired or wireless manner for further processing.

In some embodiments, the controller 1450 may include a central processing unit (CPU), an application-specific integrated circuit (ASIC), an application-specific instruction-set processor (ASIP), a graphics processing unit (GPU), a physical processing unit (PPU), a digital signal processor (DSP), a field-programmable gate array (FPGA), a programmable logic device (PLD), a controller, a microcontroller unit, a reduced instruction set computer (RISC), a microprocessor, or the like, or any combination thereof.

In some embodiments, at least one of the earphone core 1410, the auxiliary function module 1420, the flexible circuit board 1430, the power source assembly 1430, and the controller 1450 may be disposed in a housing of the speaker 1400. The connection and/or communication between the electronic components may be wired or wireless. The wired connection may include metal cables, fiber optical cables, hybrid cables, or the like, or any combination thereof. The wireless connection may include a local area network (LAN), a wide area network (WAN), a Bluetooth™, a ZigBee™, a near field communication (NFC), or the like, or any combination thereof.

The description of the speaker 1400 may be for illustration purposes, and not intended to limit the scope of the present disclosure. For those skilled in the art, various changes and modifications may be made according to the description of the present disclosure. For example, the components and/or functions of the speaker 1400 may be changed or modified according to a specific implementation. For example, the speaker 1400 may include a storage component for storing signals containing audio information. As another example, the speaker 1400 may include one or more processors, which may execute one or more sound signal processing algorithms for processing sound signals. These changes and modifications may remain within the scope of the present disclosure.

Figure 15:
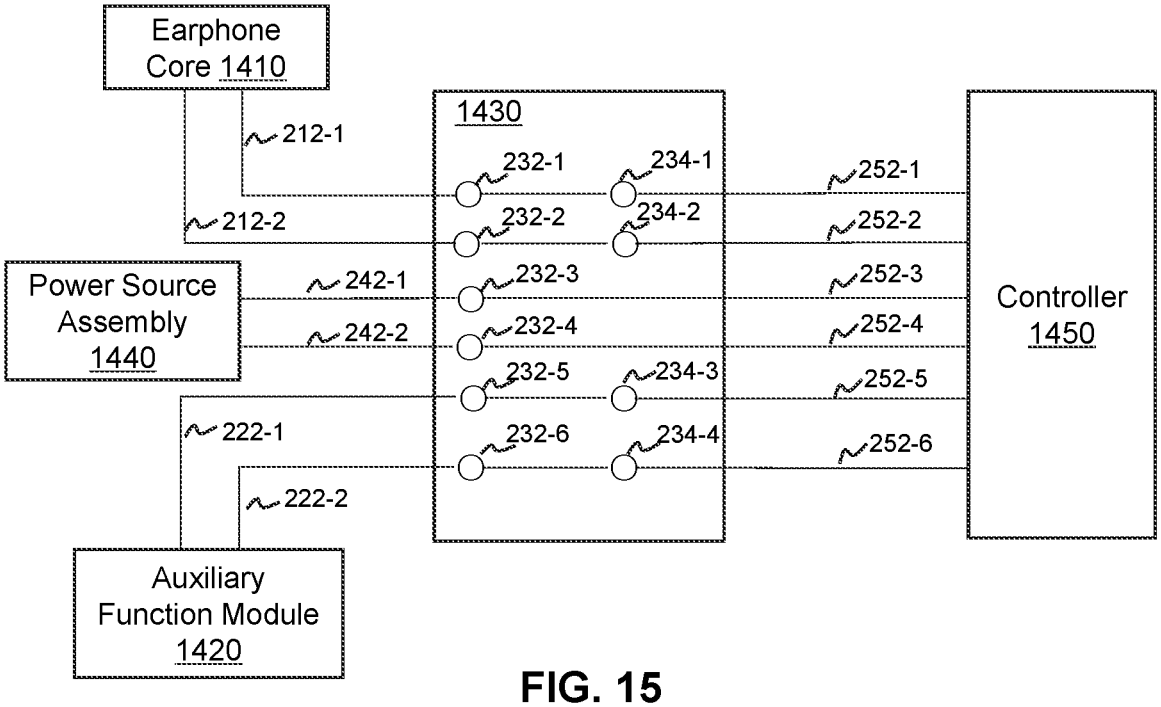
FIG. 15 is a schematic diagram illustrating an interconnection of a plurality of components in a speaker according to some embodiments of the present disclosure.

FIG. 15 is a schematic diagram illustrating an interconnection of a plurality of components in the speaker 1400 according to some embodiments of the present disclosure.

The flexible circuit board 1430 may include one or more first bonding pads (i.e., first bonding pads 232-1, 232-2, 232-3, 232-4, 232-5, 232-6), one or more second bonding pads (i.e., second bonding pads 234-1, 234-2, 234-3, 234-4), and one or more flexible wires. At least one first bonding pad in the flexible circuit board 1430 may be connected to the at least one second bonding pad in a wired manner. Merely by way of example, the first bonding pad 232-1 and the second bonding pad 234-1 may be connected through a flexible wire. The first bonding pad 232-2 and the second bonding pad 234-2 may be connected through a flexible wire. The first bonding pad 232-5 and the second bonding pad 234-3 may be connected through a flexible wire. The first bonding pad 232-5 and the second bonding pad 234-3 may be connected through a flexible wire, and the first bonding pad 232-6 and the second bonding pad 234-4 may be connected through a flexible wire.

In some embodiments, each component in the speaker 1400 may be separately connected to one or more bonding pads. For example, the earphone core 1410 may be electrically connected to the first bonding pad 232-1 and the first bonding pad 232-2 through a wire 212-1 and a wire 212-2, respectively. The auxiliary function module 1420 may be connected to the first bonding pad 232-5 and the first bonding pad 232-6 through a wire 222-1 and a wire 222-2, respectively. The controller 1450 may be connected to the second bonding pad 234-1 through a wire 252-1, connected to the second bonding pad 234-2 through a wire 252-2, connected to the first bonding pad 234-3 through a wire 252-3, connected to the first bonding pad 232-4 through a wire 252-4, connected to the second bonding pad 234-3 through a wire 252-5, and connected to the second bonding pad 234-4 through a wire 252-6. The power source assembly 1440 may be connected to the first bonding pad 234-3 through a wire 242-1, and connected to the first bonding pad 232-4 through a wire 242-2. The wire mentioned above may be a flexible wire or an external wire. The external wire may include audio signal wires, auxiliary signal wires, or the like, or a combination thereof. The audio signal wire may include a wire connected to the earphone core 1410 for transmitting an audio signal to the earphone core 1410. The auxiliary signal wire may include a wire connected to the auxiliary function module 1420 for performing signal transmission with the auxiliary function module 1420. For example, the wire 212-1 and the wire 212-2 may be audio signal wires. As another example, the wire 222-1 and the wire 222-2 may be auxiliary signal wires. As another example, the wires 252-1 through 252-6 may include audio signal wires and auxiliary signal wires. In some embodiments, one or more grooves for burying wires may be provided in the speaker 1400 for placing the wires and/or the flexible wires.

Merely by way of example, a user of the speaker 1400 may send signals to the speaker 1400 by pressing a key (e.g., a signal for playing music). The signals may be transmitted to the first bonding pad 232-5 and/or the first bonding pad 232-6 of the flexible circuit board 1430 through the wire 222-1 and/or the wire 222-2, then be transmitted to the second bonding pad 234-3 and/or second bonding pad 234-4 through a flexible wire. The signals may be transmitted to the controller 1450 through the wire 252-5 and/or the wire 252-6 that are connected to the second bonding pad 234-3 and/or the second bonding pad 234-4. The controller 1450 may analyze and process the received signals, and generate corresponding instructions according to the processed signals. The instructions generated by the controller 1450 may be transmitted to the flexible circuit board 1430 through one or more of the wires 252-1 through 252-6. The instructions generated by the controller 1450 may be transmitted to the earphone core 1410 through the wire 212-1 and/or the wire 212-2 that are connected to the flexible circuit board 1430, and may control the earphone core 1410 to play related music. The instructions generated by the controller 1450 may be transmitted to the power source assembly 1440 through the wire 242-1 and/or the wire 242-2 that are connected to the flexible circuit board 1430, and may control the power source assembly 1440 to provide other components with power required to play music. The connection through the flexible circuit board 1430 may simplify the wire routing of different components in the speaker 1400, reduce mutual influences between the wires, and save the space occupied by the inner wires in the speaker 1400.

Figure 16:
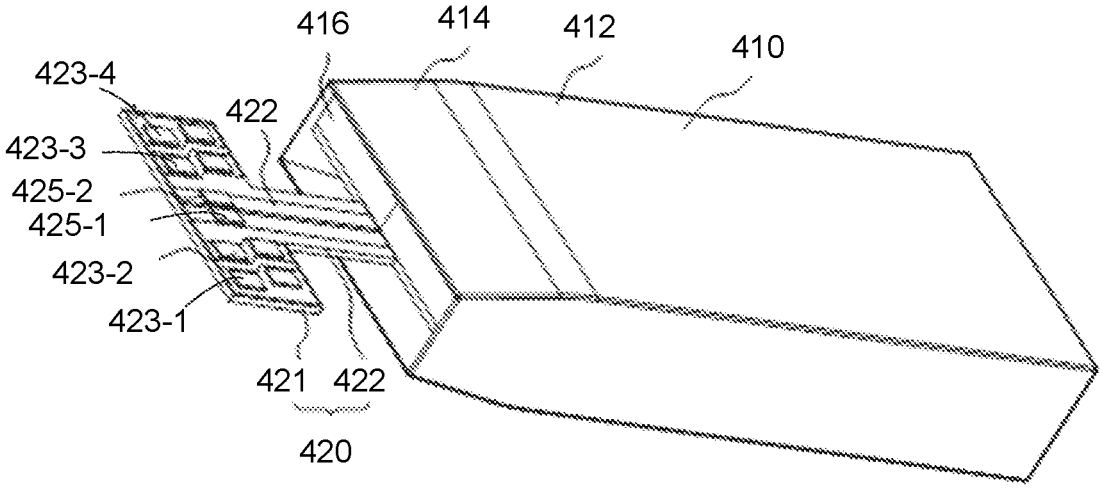
FIG. 16 is a schematic diagram illustrating an exemplary power source assembly in a speaker according to some embodiments of the present disclosure.

FIG. 16 is a schematic diagram illustrating an exemplary power source assembly in a speaker according to some embodiments of the present disclosure. The power source assembly 1600 may be an exemplary power source assembly 1440 as described in FIGS. 14 and 15.

As shown in FIG. 16, the power source assembly 1600 may include a battery 410 and a flexible circuit board 420. In some embodiments, the battery 410 and the flexible circuit board 420 may be disposed in a housing of a speaker (e.g., the speaker 1400) as described elsewhere in the present disclosure.

The battery 410 may include a body region 412 and a sealing region 414. In some embodiments, the sealing region 414 may be disposed between the flexible circuit board 420 and the body region 412, and may be connected to the flexible circuit board 420 and the body region 412. A connection manner of the sealing region 414 with the flexible circuit board 420 and the body region 412 may include a fixed connection and/or a movable connection. In some embodiments, the sealing region 414 and the body region 410 may be tiled, and the thickness of the sealing region 414 may be less than or equal to the thickness of the body region 412, such that the at least one side of the sealing region 414 and a surface of the body region 410 adjacent to the at least one side may have a shape of a stair. In some embodiments, the battery 410 may include a positive terminal and a negative terminal. The positive and negative terminals may be connected directly or indirectly (e.g., through flexible circuit board 420) to other components in the speaker.

In some embodiments, the flexible circuit board 420 may include a first board 421 and a second board 422. The first board 421 may include a first bonding pad a second bonding pad, and a flexible wire. The first bonding pad may include a third bonding pad group 423-1, a third bonding pad group 423-2, a third bonding pad group 423-3, and a third bonding pad group 423-4. Each third bonding pad group may include one or more fourth bonding pads, for example, two fourth bonding pads. The second bonding pad may include a second bonding pad 425-1 and a second bonding pad 425-2. The one or more fourth bonding pads of each of the third bonding pad groups of the first bonding pad may connect two or more components of the speaker. For example, a fourth bonding pad in the third bonding pad group 423-1 may be connected to the earphone core (e.g., earphone core 1410) through an external wire. A fourth bonding pad may be connected to another fourth bonding pad in the third bonding pad group 423-1 through a flexible wire disposed on the second board 422. Another fourth bonding pad in the third bonding pad group 423-1 may be connected to a controller (e.g., the controller 1450) of the speaker through an external wire, thereby connecting an earphone core (e.g., the earphone core 1410) of the speaker and the controller for communication. As another example, a fourth bonding pad in the third bonding pad group 423-2 may be connected to a Bluetooth module of the speaker through an external wire. The fourth bonding pad in the third bonding pad group 423-2 may be connected to another fourth bonding pad in the third bonding pad group 423-2 through a flexible wire. The another fourth bonding pad in the third bonding pad group 423-2 may be connected to the earphone core through an external wire, thereby connecting the earphone core to the Bluetooth module, so that the speaker may play audio information through the Bluetooth connection. One or more second bonding pads (e.g., the second bonding pads 425-1 and 425-2) may be used to connect the one or more components of the speaker to the battery 410. For example, the second bonding pad 425-1 and/or the second bonding pad 425-2 may be connected to the earphone core through an external wire. The second bonding pad 425-1 and/or the second bonding pad 425-2 may be connected to the battery 410 through a flexible wire provided on the second board 422, thereby connecting the earphone core and the battery 410.

There may be multiple arrangements of the first bonding pads 423 and the second bonding pads 425. For example, all the bonding pads may be arranged along a straight line, or be arranged at other shapes. In some embodiments, one or more groups of the first bonding pads 423 may be spaced apart along a length direction of the first board 421. One or more fourth bonding pads in each of the third bonding pad groups of the first bonding pad may be disposed along a width direction of the first board 421. The one or more fourth pads may be staggered and spaced along the length of the first bonding pad. One or more second bonding pads 425 may be disposed in the middle region of the first board 421. One or more second bonding pads 425 may be disposed along the length direction of the first board 421. In this way, on the one hand, it may be possible to avoid the formation of a flush interval region between adjacent two groups of third bonding pads, so that the strength distribution on the first board 421 may be uniform. Occurrence of bending between adjacent two groups of third bonding pads may be reduced, and a probability of the first board 421 being broken due to the bending may be reduced to protect the first board 421. On the other hand, it may increase the distance between the bonding pads, thereby facilitating the welding as well as reducing short circuits between different bonding pads.

In some embodiments, the second board 422 may be provided with one or more flexible wires 422 for connecting the bonding pads on the first board 421 to the battery 410. Merely by way of example, the second board 422 may include two flexible wires. One end of each of the two flexible wires may be connected to the positive terminal and the negative terminal of the battery 410, respectively, and the other end of each of the two flexible wires may be connected to a pad on the first board 421. Therefore, there may be no need to provide additional bonding pads to lead out the positive and negative electrodes of the battery 410, which may reduce the number of bonding pads and simplify structures and technologies used herein. Since only the flexible wire is provided on the first board 421, in some embodiments, the second board 422 may be bent similarly according to specific conditions. For example, the second board 422 may be bent to fix one end of the first board 421 to the battery 410, thereby reducing the volume of the power source assembly 1600, saving the space for housing the power source assembly 1600 in the speaker and improving a space utilization rate. As another example, by folding the second board 422, the first board 421 may be attached to the side surface of the battery 410, such that the second board 422 may be stacked with the battery 410, thereby reducing the space occupied by the power source assembly 1600 greatly.

In some embodiments, the flexible circuit board 420 may be an integral part, and the first board 421 and the second board 422 may be two regions of the flexible circuit board. In some embodiments, the flexible circuit board 420 may be divided into two independent parts, for example, the first board 421 and the second board 422 may be two independent boards. In some embodiments, the flexible circuit board 420 may be disposed in a space formed by the body region 412 and/or the sealing region 414 of the battery 410, so that there is no need to provide a separate space for the flexible circuit board 420, thereby further improving the space utilization.

In some embodiments, the power source assembly 1600 may further include a hard circuit board 416. The hard circuit board 416 may be disposed in the sealing region 414. The positive and negative terminals of a specific battery 410 may be disposed on the hard circuit board 416. Further, a protection circuit may be provided on the hard circuit board 416 to protect the battery 410 from overloading. An end of the second board 422 far away from the first board 421 may be fixedly connected to the hard circuit board 416, so that the flexible wires on the second board 422 may be connected to the positive terminal and the negative terminal of the battery 410, respectively. In some embodiments, the second board 422 and the hard circuit board 416 may be pressed together during fabrication.

In some embodiments, the shapes of the first board 421 and the second board 422 may be set according to actual conditions. The shapes of the first board 421 and the second board 422 may include a square, a rectangle, a triangle, a polygon, a circle, an oval, an irregular shape, or the like. In some embodiments, the shape of the second board 422 may match the shape of the sealing region 414 of the battery 410. For example, both the shapes of the sealing region 414 and the second board 422 may be rectangular, and the shape of the first board 421 may also be rectangular. And the first board 421 may be disposed at one end in the length direction of the second board 422 and be perpendicular to the second board 422 along the length direction. Further, the second board 422 may be connected to the middle region in the length direction of the first board 421, so that the first board 421 and the second board 422 may be disposed in a T shape.

In some embodiments, when the user wears the speaker (e.g., the speaker 1400), the speaker may be on at least one side of the user's head, and be close to but not block the user's ear. The speaker may be worn on the user's head (e.g., open earphones worn off the ears with glasses, headbands, or other means) or on other parts of the user's body, such as the user's neck/shoulders.

Figure 17:
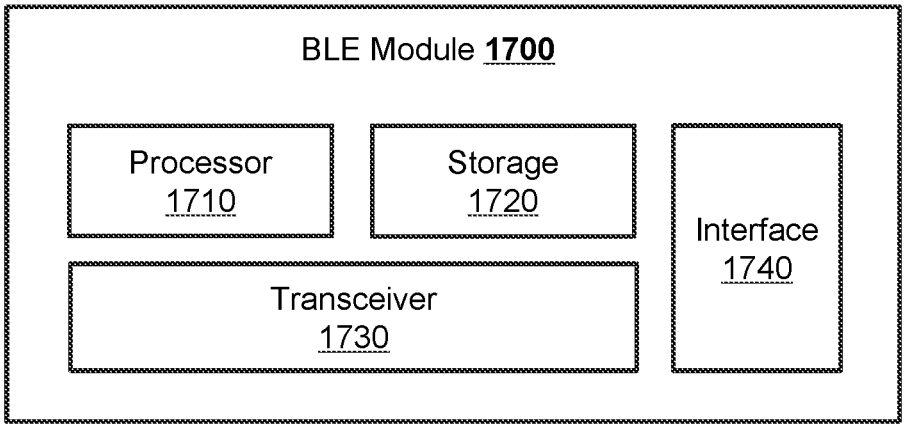
FIG. 17 is a schematic diagram illustrating an exemplary bluetooth low energy (BLE) module according to some embodiments of the present disclosure.

In some embodiments, the speaker described elsewhere in the present disclosure may further include a Bluetooth low energy (BLE) module for implementing Bluetooth modules used in the speaker. FIG. 17 is a schematic diagram illustrating an exemplary BLE module according to some embodiments of the present disclosure. The BLE module 1700 may include a processor 1710, a storage 1720, a transceiver 1730, and an interface 1740.

The BLE module 1700 may facilitate communications between components of the speaker (e.g., one or more sensors such as a locating sensor, an orientation sensor, an inertial sensor, etc.) or a communication between the speaker and an external device (e.g., a terminal device of a user, a cloud data center, a peripheral device of the speaker, etc.) using BLE technology. BLE is a wireless communication technology published by the Bluetooth Special Interest Group (BT-SIG) standard as a component of Bluetooth Core Specification Version 4.0. BLE is a lower power, lower complexity, and lower cost wireless communication protocol, designed for applications requiring lower data rates and shorter duty cycles. Inheriting the protocol stack and star topology of classical Bluetooth, BLE redefines the physical layer specification, and involves new features such as a very-low power idle mode, a simple device discovery, and short data packets, etc.

The transceiver 1730 may receive data (e.g., an audio message) to be played by the speaker. The transceiver 1730 may include any suitable logic and/or circuitry to facilitate receiving signals from and/or transmitting signals to other components of the speaker or an external device wirelessly. In some embodiments, the transceiver 1730 may transmit the received data to the processor 1710 for processing. For example, the processor 1710 may perform a noise reduction on the received data. As another example, the processor 1710 may serve as an equalizer, which adjusts the volume, the tone, etc. of an audio message adaptively according to actual needs. In some embodiments, the processor 1710 may execute instructions embodied in software (including firmware) associated with the operations of BLE module 1700 for managing the operations of transceiver 1730. In some embodiments, the processor 1710 may facilitate processing and forwarding of received data from the transceiver 1730 and/or processing and forwarding of data to be transmitted by the transceiver 1730. The storage 1720 may store one or more instructions executed by the processor 1710, dated received from the transceiver 1730 and/or data to be transmitted by the transceiver 1730, or the like. The storage 1720 may include but is not limited to, RAM, ROM, flash memory, a hard drive, a solid state drive, or other volatile and/or non-volatile storage devices. The BLE module 1700 may interact with one or more modules or components of the speaker via the interface 1740.

It will be appreciated that, in some embodiments, the functionality of one or more of the processor 1710, the storage 1720, the transceiver 1730, and/or the interface 1740 may be integrated with one or more modules of the speaker on a same circuit board, such as a system on a chip (SOC), an application specific integrated circuit (ASIC), etc. In some embodiments, the BLE module 1700 or one or more components thereof may be integrated on a same circuit board with the earphone core 1410 and/or the controller 1450. The circuit board may connect to the power source assembly through the flexible circuit board 1430.

Figure 18:
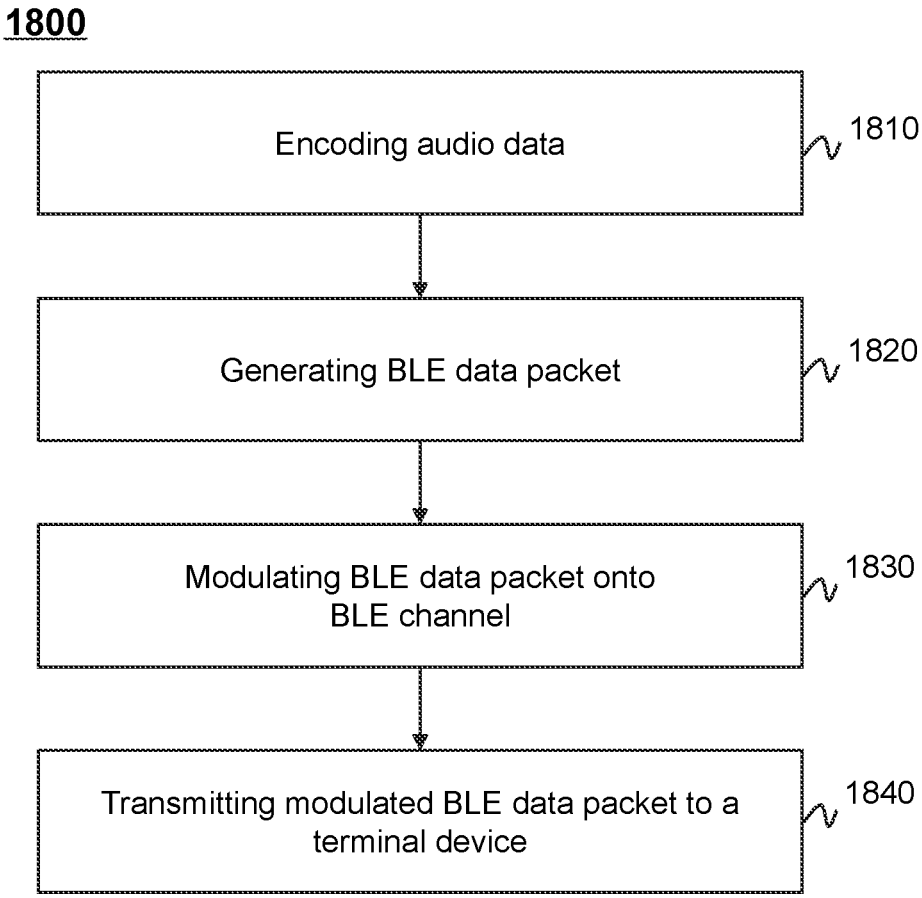
FIG. 18 is a flow chart illustrating an exemplary process for transmitting audio data to a terminal device through a BLE module according to some embodiments of the present disclosure.

FIG. 18 is a flow chart illustrating an exemplary process for transmitting data to another device (e.g., a terminal device) through a BLE module (e.g., the BLE module 1700) according to some embodiments of the present disclosure.

In 1810, data may be encoded. In some embodiments, a speaker (e.g., the speaker 1400) may transmit the data to another device through the BLE module 1700. The BLE module may encode the data to be transmitted. In some embodiments, the BLE module 1700 may encode the data using a Low Complexity Communications Codec (LC3).

In 1820, a BLE data packet may be generated. A BLE data packet may be generated based on the encoded data. In some embodiments, the BLE module 1700 may obtain parameters or attributes associated with the data before the BLE data packets are generated. The parameters or attributes associated with the data may include parameters for decoding the data (e.g., the codec of the data), parameters for demodulating the data, the volume of the data, the tone of the data, the content of the data, or the like, or any combination thereof. In some embodiments, the BLE data packets may also include the parameters or attributes associated with the data. In some embodiments, the data may be divided into multiple data segments of particular sizes if the data is oversized. A BLE data packet may be generated based on each data segment such that the transmission speed of the data may be improved.

In 1830, the BLE data packet may be modulated onto a BLE channel. In some embodiments, if the data is divided into multiple data segments, multiple BLE channels may be established, and each of the multiple data segments may be modulated onto a BLE channel.

In 1840, the modulated BLE data packet may be transmitted to another device through the BLE channel. In some embodiments, data transmission between the BLE module 1700 and the another device may be implemented according to a protocol suitable for BLE.

Figure 19:
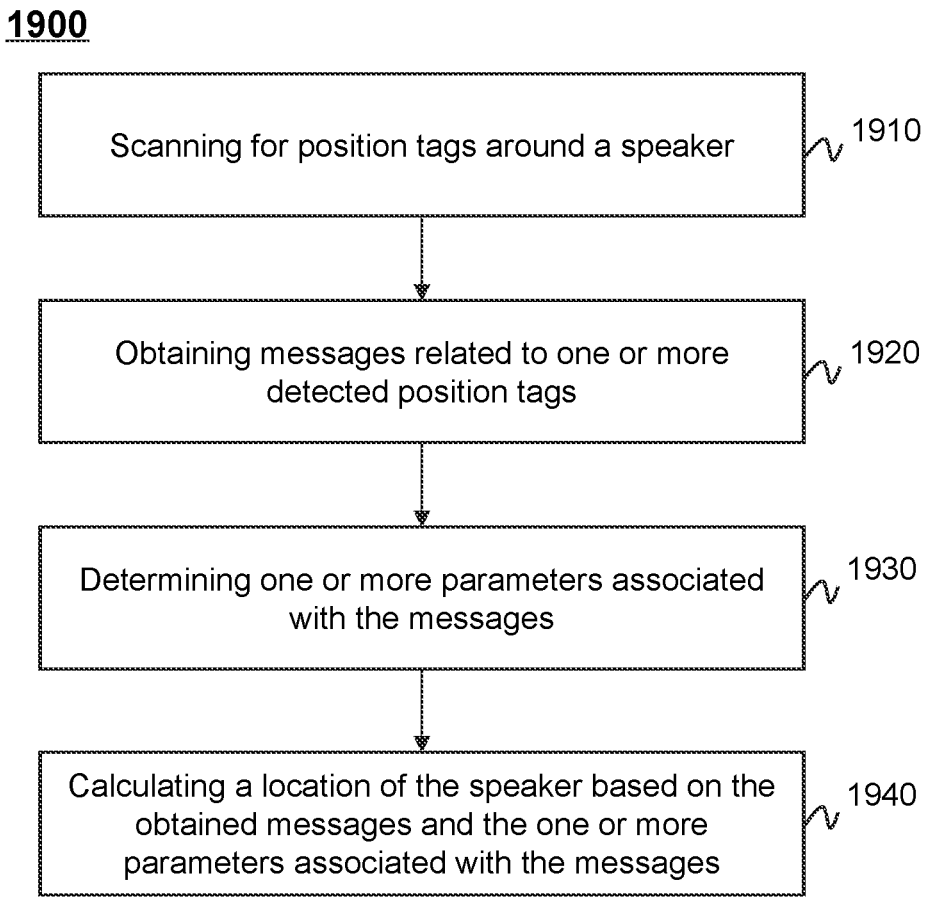
FIG. 19 is a flow chart illustrating an exemplary process for determining a location of a speaker using a BLE module according to some embodiments of the present disclosure.

FIG. 19 is a flow chart illustrating an exemplary process for determining a location of a speaker using a BLE module (e.g., the BLE 1700) according to some embodiments of the present disclosure.

In some embodiments, the BLE module 1700 may determine a location of the speaker. The BLE module 1700 may function as a locating sensor. In some embodiments, the locating sensor may be omitted in the speaker, thus reducing the size, the weight, and the power consumption of the speaker. In some embodiments, the BLE module 1700 may determine the location of the speaker by performing the operations 1910 through 1940 in the process 1900.

In 1910, position tags around the speaker may be scanned. In some embodiments, a position tag refers to an identifier indicating a position of a BLE device. In some embodiments, the identifier may include a character string representing the position of the BLE device. In some embodiments, the identifier may further include character strings representing a name, a service, a device ID, etc., of the BLE device. In some embodiment, the BLE device may be a BLE transceiver set at a virtual or physical location. In some embodiments, the BLE device may be another BLE module implemented in a terminal device (e.g., a mobile phone, a smart wearable device, etc.) of a user. In some embodiments, the BLE module 1700 may scan for position tags in a certain range (e.g., in a circular range centered by the acoustic output apparatus with a radius of 100 meters). In some embodiments, the manner in which the scanning operation is performed, a frequency of scanning operation, and a width of a scanning window (e.g., the certain range) of the scanning operation may be set by a user (e.g., a wearer of the speaker), according to default settings of the speaker, etc. Within the scanning window, the BLE module 1700 may detect position tags of multiple BLE devices sensed by the transceiver 1730.

In 1920, messages related to one or more detected position tags may be obtained within the scanning window. In some embodiments, the BLE module 1700 may detect multiple position tags, and obtain messages including identifiers from BLE devices corresponding to the multiple position tags. In some embodiments, the processor 1710 of the BLE module 1700 may determine if the messages are obtained from "allowed" BLE devices (e.g., qualified BLE transceivers). The BLE module 1700 may determine a value of an identifier contained in each message. In some embodiments, a value of an identifier contained in a message may be determined based on at least one of character strings of the position, the name, the service, the device ID, etc. of the identifier. The processor 1710 of the BLE module 1700 may compare the value with one or more preset values. In some embodiments, the BLE module 1700 may identify the one or more position tags and corresponding "allowed" BLE devices according to the comparison. In some embodiments, in order to provide a relatively precise position of the speaker, at least three position tags may be obtained within the scanning window.

In 1930, one or more parameters associated with the messages may be determined. When the BLE module 1700 confirms that the messages are obtained from the "allowed" BLE devices, the processor 1710 may instruct the BLE module 1700 to record a radio parameter associated with each message. In some embodiments, the radio parameter may include a received signal strength indicator (RSSI) value, a bit error rate (BER), etc. In some embodiments, the message, the radio parameter regarding the message, and the identifier obtained from the message may be stored in the storage 1720.

In 1940, the location of the speaker may be calculated based on the obtained messages and the one or more parameters associated with the messages. In some embodiments, the processor 1710 may calculate a relative location of the acoustic output apparatus relative to the "allowed" BLE devices from which the one or more position tags are obtained based on the messages and the one or more parameters associated with the messages. Since locations of the "allowed" BLE devices are known, the location of the speaker (e.g., in forms of coordinates of latitude and longitude) may be determined based on the relative location of the speaker relative to the "allowed" BLE devices. The determination of the location of the speaker may be performed using any suitable methods. In this way, the calculation of the location of the speaker may use less battery power. In some embodiments, if there are more than three position tags are detected, and messages related to the position tags are obtained, the processor 1710 may rank the messages according to the RSSI values associated with the messages. Messages corresponding to three highest RSSI values may be identified from the more than three messages, and the identified messages and the one or more parameters associated with the messages may be used to determine the location of the speaker.

In some embodiments, the location of the speaker may be determined at any suitable frequency. Determined locations of the speaker may be filtered in any suitable manner so as to minimize errors due to external factors, such as a person standing between the speaker and the "allowed" BLE devices.

It should be noted that the above description of the process 1900 is merely provided for the purposes of illustration, and not intended to limit the scope of the present disclosure. For persons having ordinary skills in the art, multiple variations or modifications may be made under the teachings of the present disclosure. For example, the BLE module may also be used to determine a direction of the speaker relative to a BLE device nearby. However, those variations and modifications do not depart from the scope of the present disclosure.

The embodiments described above are merely implements of the present disclosure, and the descriptions may be specific and detailed, but these descriptions may not limit the present disclosure. It should be noted that those skilled in the art, without deviating from concepts of the bone conduction speaker, may make various modifications and changes to, for example, the sound transfer approaches described in the specification, but these combinations and modifications are still within the scope of the present disclosure.

What is claimed is:

1. A bone conduction speaker, comprising:

a vibration device comprising a vibration conductive plate and a vibration board, wherein the vibration conductive plate is physically connected with the vibration board, vibrations generated by the vibration conductive plate and the vibration board have at least two resonance peaks, frequencies of the at least two resonance peaks being catchable with human ears, and sounds are generated by the vibrations transferred through a human bone; and a power source assembly configured to provide electrical power;

a controller configured to control the bone conduction speaker to generate sound; and a Bluetooth low energy (BLE) module configured to establish communication between the bone conduction speaker and a terminal device of a user.

2. The bone conduction speaker according to claim 1, wherein the power source assembly, the controller, and the BLE module are disposed in a housing of the bone conduction speaker.

3. The bone conduction speaker according to claim 1, wherein the BLE module is configured to transmit data between the bone conduction speaker and the terminal device.

4. The bone conduction speaker according to claim 3, wherein to transmit the data, the BLE module is configured to:

encode the data to be transmitted to the terminal device;

generate a BLE data packet based on the encoded data and attributes of the data;

modulate the BLE data packet onto a BLE channel; and transmit the modulated BLE data packet to the terminal device through the BLE channel.

5. The bone conduction speaker according to claim 1, wherein the BLE module is further configured to determine a location of the user.

6. The bone conduction speaker according to claim 5, wherein to determine the location of the user, the BLE module is configured to:

scan position tags around the bone conduction speaker;

obtain messages related to one or more detected position tags within a scanning window;

determine one or more parameters associated with the messages; and calculate the location of the bone conduction speaker based on the messages and the one or more parameters associated with the messages.

7. The bone conduction speaker according to claim 1, further comprising a flexible circuit board including one or more bonding pads or one or more flexible wires.

8. The bone conduction speaker according to claim 7, wherein the BLE module is integrated on a same circuit board with the controller and the vibration device, and the circuit board is connected to the power source assembly through the flexible circuit board.

9. The bone conduction speaker according to claim 1, wherein the controller is further configured to control the power source assembly.

10. The bone conduction speaker according to claim 9, wherein to control the power source assembly, the controller is further configured to:

receive state information of the power source assembly; and generate an instruction to control the power source assembly based on the state information of the power source assembly.

11. The bone conduction speaker according to claim 1, wherein the controller is further configured to:

receive a sound signal from the user; and generate a control instruction related to the sound signal to control the vibration device.

12. The bone conduction speaker according to claim 1, wherein the power source assembly includes a battery and a flexible circuit board.

13. The bone conduction speaker according to claim 12, wherein the battery includes a body region and a sealing region, the sealing region being disposed between the flexible circuit board and the body region, and being connected to the flexible circuit board and the body region.

14. The bone conduction speaker according to claim 12, wherein the flexible circuit board includes a first board and a second board.

15. The bone conduction speaker according to claim 14, wherein the controller is connected to the BLE module based on the first board through external wires.

16. The bone conduction speaker according to claim 14, wherein the controller is connected to the battery based on the second board through external wires.

17. The bone conduction speaker according to claim 1, wherein the vibration conductive plate includes a first torus and at least two first rods, the at least two first rods converging to a center of the first torus.

18. The bone conduction speaker according to claim 17, wherein the vibration board includes a second torus and at least two second rods, the at least two second rods converging to a center of the second torus.

19. The vibration device according to claim 18, wherein the first torus is fixed on a magnetic component.

20. The vibration device according to claim 19, further comprising a voice coil, wherein the voice coil is driven by the magnetic component and fixed on the second torus.

* * * * *